US005356761A

United States Patent [19]

Morimoto et al.

[11] Patent Number: 5,356,761

[45] Date of Patent: Oct. 18, 1994

[54] DEVELOPMENT OF SILVER HALIDE PHOTOSENSITIVE MATERIAL AND DEVELOPER

[75] Inventors: Kiyoshi Morimoto; Hiroshi Hayakawa; Takashi Toyoda; Mitsunori Hirano, all of Kanagawa, Japan

[73] Assignee: Fuji Photo Film Co., Ltd., Kanagawa, Japan

[21] Appl. No.: 202,887

[22] Filed: Feb. 28, 1994

Related U.S. Application Data

[63] Continuation of Ser. No. 861,521, Apr. 1, 1992, abandoned.

[30] Foreign Application Priority Data

Apr. 2, 1991 [JP] Japan ..... 3-094955
Apr. 18, 1991 [JP] Japan ..... 3-112275
Jul. 5, 1991 [JP] Japan ..... 3-191288

[51] Int. Cl.[5] ..... G03C 5/305

[52] U.S. Cl. ..... 430/488; 430/434; 430/445; 430/446; 430/486

[58] Field of Search ..... 430/434, 445, 446, 486, 430/488

[56] References Cited

U.S. PATENT DOCUMENTS 3,240,603 3/1966 Schuler et al. ..... 430/456
4,254,215 3/1981 Kramp et al. ..... 430/488
4,839,273 6/1989 Yamada et al. ..... 430/464

FOREIGN PATENT DOCUMENTS 4023143 1/1991 Fed. Rep. of Germany .
4835493 10/1973 Japan .
204037 11/1984 Japan .
6024464 6/1985 Japan .
1296161 11/1972 United Kingdom .

*Primary Examiner*—Hoa Van Le
*Attorney, Agent, or Firm*—Sughrue, Mion, Zinn, Macpeak & Seas

[57] ABSTRACT

Development of silver halide photosensitive material with a developer containing a developing agent and a free sulfite is accompanied by deposition of silver sludge. Silver sludge is effectively suppressed by adding to the developer (a) a six-membered heterocyclic compound which has a six-membered ring containing two nitrogen atoms and has a mercapto group, a hydroxyl group and one or two substituents having 2 to 20 carbon atoms in total or (a') a six-membered heterocyclic compound which has a six-membered ring containing three nitrogen atoms and has a mercapto group and a hydroxyl group.

5 Claims, No Drawings

DEVELOPMENT OF SILVER HALIDE PHOTOSENSITIVE MATERIAL AND DEVELOPER

This is a continuation of application Ser. No. 07/861,521 filed Apr. 1, 1992, now abandoned.

This invention relates to a method for developing a photographic silver halide photosensitive material and a developer used therein, and more particularly, to a method for developing a silver halide photosensitive material through a developing machine in such a manner as to minimize silver stain or sludge on machine parts including a tank, a rack and rollers, thereby ensuring easier daily maintenance of the machine.

BACKGROUND OF THE INVENTION

In general, automatic developing machines or processors are often utilized for the development of silver halide photosensitive material from the standpoints of quickness and ease of operation and handling. The processors involve a series of steps of development, fixation, washing and drying. There is an increasing demand for more rapid development. One typical means for accelerating development is to increase the activity of developer. For the rapid development of black-and-white photosensitive material, the activity of developer may be increased by increasing the concentration of a developing agent or increasing the pH of the developer. It is, however, difficult to maintain the developer active because the developer undergoes substantial degradation by air oxidation. Another approach for rapid processing is made from the aspect of photosensitive material. Reducing the thickness of photosensitive material (e.g., protective layer) is effective for rapid processing.

It is well known from early days to use sulfites in order to prevent degradation of developer. When the sulfites which are capable of dissolving silver halides are added to developer, silver can be dissolved from the photosensitive material into the developer as a silver sulfite complex. As the silver complex is reduced in the developer, silver gradually deposits and accumulates on the developing tank and rollers. This is known as silver sludge or stain. Since silver sludge can deposit on photosensitive material being processed thus staining images, the processor should be washed at intervals, that is, periodic maintenance is necessary. If the amount of sulfite added is increased, the amount of dissolving out silver sulfite complex is also increased and the degree of silver sludging is accordingly increased, offsetting the benefits of rapid processing.

One known method for reducing silver sludging is by adding a compound capable of diminishing silver ions dissolving into the developer and/or controlling reduction of silver ions into silver as disclosed in Japanese Patent Application Unexamined Publication (JP-A) No. 24347/1981. This method, however, inevitably retards development itself and lowers sensitivity. Such a sensitivity lowering is a serious drawback for a photosensitive material/development system which is desired to have as high sensitivity as possible. Although it is quite effective for rapid processing to reduce the thickness of photosensitive material (e.g., protective layer), processing of such relatively thin photosensitive material through the processor on the running mode suffers from the problem that more silver ions are dissolved into the developer, aggravating silver sludging. The method of JP-A 24347/1981 is insufficient in preventing silver sludging. There is a desire for a further improvement.

Japanese Patent Publication (JP-B) Nos. 46585/1981 and 28495/1987 disclose another method for reducing silver sludging by adding select compounds. The compounds described therein have an improved anti-sludging function, but they are not necessarily stable and would immediately lose their activity in the system where the developer is subject to air oxidation. There is a need for a further improvement.

Mercaptopyrimidine compounds are known from early days and some have been utilized in the photographic art. U.S. Pat. No. 3,240,603 and UK Patent No. 957,807 utilize mercaptopyrimidine compounds as fixing agents for silver halides. High pH solutions of mercaptopyrimidine compounds in high concentrations are effective fixers. In fact, at least 8 grams of mercaptopyrimidine compound is used in U.S. Pat. No. 3,240,603.

JP-B 24464/1985 utilizes mercaptopyrimidine compounds in bleach-fixing solution for promoting bleaching action.

German Pat. No. 21 26 297 utilizes mercaptopyrimidine compounds in the second developer of a color reversal system for the purpose of increasing the sensitivity thereof. Exemplary is 2-mercapto-4-hydroxy-6-methylpyrimidine. Evaluating this compound, the inventors found that it is effective for preventing silver sludge from depositing, but to a less extent. There is a need for a further improvement.

U.S. Pat. No. 3,597,199 utilizes mercaptopyrimidine derivatives in the second developer of a color reversal system for the purpose of improving photographic properties. Exemplary is 2-mercapto-4-hydroxy-6-aminopyrimidine. Evaluating this compound, the inventors found that it does not have a satisfactory function of preventing silver sludge.

JP-A 204037/1984 utilizes heterocyclic mercapto compounds in black-and-white developer at pH 11.5 or higher for the purpose of preventing silver sludging. One exemplified compound is 2-mercapto-4-hydroxypyrimidine. Testing this compound, we found that it is not necessarily effective for preventing silver sludging.

JP-B 35493/1973 utilizes heterocyclic mercapto compounds in developers for preventing silver sludging. Exemplary is 2-mercapto-4-hydroxy-6-methylpyrimidine. It is effective for preventing silver sludge from depositing to a less extent as mentioned above.

UK Pat. No. 1,296,161 uses mercaptopyrimidine derivatives in developers of the silver salt diffusion transfer type for the purpose of preventing silver sludging. Exemplary is 2-mercapto-4-hydroxy-6-carboxyquinazoline. Evaluating this compound, the inventors found that it does not have a satisfactory function of preventing silver sludge.

As mentioned above, there are known a number of examples utilizing mercaptopyrimidine compounds in processing solution. Several mercaptopyrimidine compounds are used as fixers in concentrated high pH solution form while some are known as agents for preventing silver sludge. Since heretofore known mercaptopyrimidine compounds are not fully effective for preventing silver sludge, there is a need for a substantial improvement.

JP-B 121854/1989 discloses a black-and-white developer which contains an amino or heterocyclic compound having a group capable of adsorbing silver halide for achieving improved photographic quality and preventing black pepper. Exemplary are 1-morpholinopropyl-5-mercaptotetrazole and 1-morpholinoethyl-2-mercaptoimidazole. These compounds were not found to be fully effective for preventing silver sludge.

Several mercaptotriazine compounds have been used in the photographic art. JP-B 24464/1985 uses a mercaptotriazine in a bleach-fixer for promoting bleaching. JP-A 5334/1974 adds a heterocyclic mercapto compound to a lith developer to thereby remove trailing of photographic high contrast photosensitive material. Exemplary is 2,4,6-trimercapto-1,3,6-triazine. JP-A 204037/1984 discloses a black-and-white developer at pH 11.5 or higher which contains a heterocyclic mercapto compound, for example, 2,4-dimercapto-6-hydroxy-l,3,5-triazine for preventing silver sludge. JP-A 53244/1991 uses mercapto-1,3,5-triazine in a dveloper for preventing silver sludge. An example is 2,4-dimercapto-6-hydroxy-1,3,5-triazine again. Evaluating these compounds, we found that they do not have a satisfactory function of preventing silver sludge.

One prior art well-known image toner is 1-phenyl-5-mercaptotetrazole (see T. H. James, The Theory of the Photographic Process, Ch. 16, page 476) which greatly affects photographic properties such as fog, sensitivity and gradation. There is a desire for a method capable of approximating yellow brown color tone to completely neutral with minimal influence on photographic properties.

SUMMARY OF THE INVENTION

Therefore, an object of the present invention is, in conjunction with rapid processing of silver halide photosensitive material, first to reduce silver sludging in a developing tank and/or on a developing rack and rollers, second to facilitate the maintenance of an automatic processor or developing instrument, third to reduce silver sludging without any influence on photographic properties, fourth to reduce silver sludging without impairing the stability of developer, and fifth to improve the image tone without any influence on photographic properties.

As described in the preamble, mercaptopyrimidine compounds were used at high pH as fixing agents for silver halide. It is expected that the addition of such a compound to a developer at high pH is disadvantageous for anti-silver-sludging purpose because the amount of silver dissolving into the developer would increase. In fact, testing 2-mercapto-4-hydroxypyrimidine exemplified in JP-A 204037/1984, we found that it is not so effective as an anti-sludging agent. Quite unexpectedly, we have found that specific compounds defined in the present invention is very effective in preventing silver sludging and improving image tone, overcoming the outstanding problems.

In a first aspect, the present invention provides a method for processing a silver halide photosensitive material after exposure through development and fixation steps for forming images therein. In the development step, the photosensitive material is treated with a developer containing at least (a) a compound of the general formula (I):

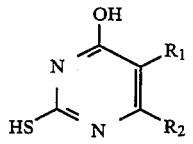

(I)

wherein $R_1$ and $R_2$ are independently selected from the group consisting of a hydrogen atom, halogen atom, alkyl, aryl, aralkyl, hydroxyl, mercapto, carboxyl, sulfo, phosphono, nitro, cyano, alkoxycarbonyl, aryloxycarbonyl, carbamoyl, sulfamoyl, and alkoxy group, the sum of carbon atoms in both $R_1$ and $R_2$ ranges from 2 to 20, and $R_1$ and $R_2$, taken together, may form a saturated ring structure. The developer further contains (b) a dihydroxybenzene developing agent, (c) at least 0.3 mol/liter of a free sulfite, and (d) at least one of 1-phenyl-3-pyrazolidone and aminophenol developing agents.

Also contemplated herein is a developer containing at least a compound of formula (I).

As mentioned in the preamble, JP-A 204037/1984 and 53244/1991 use a mercaptotriazine, 2,4-dimercapto-6-hydroxy-1,3,5-triazine in a developer. A test of this compound revealed that it does not function as a satisfactory anti-sludging agent. Investigating a number of mercaptotriazine compounds, we have found that a mercaptotriazine compound having one mercapto group and one hydroxy group is effective in preventing silver sludge and improving image tone.

In a second aspect of the present invention, there is provided a method for processing a silver halide photosensitive material after exposure for forming an image therein, comprising the step of treating the material with a developer containing a six-membered heterocyclic compound which has a six-membered ring containing three nitrogen atoms and has a mercapto group and a hydroxyl group. Preferably, the six-membered heterocyclic compound is of the general formula (II) or (III):

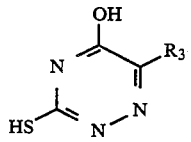

(II)

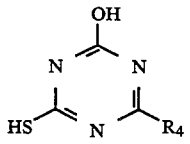

(III)

wherein $R_3$ and $R_4$ are independently selected from the group consisting of a hydrogen atom, halogen atom, alkyl, aryl, aralkyl, carboxyl, sulfo, phosphono, sulfoamino, nitro, cyano, alkoxycarbonyl, aryloxycarbonyl, carbamoyl, sulfamoyl, alkoxy, aryloxy, alkylthio, arylthio, and heterocyclic groups. The developer in the second aspect contains (a') a six-membered heterocyclic compound which has a six-membered ring containing three nitrogen atoms and has a mercapto group and a hydroxyl group, typically a compound of formula (II) or (III) and components (b), (c) and (d) as mentioned above.

DETAILED DESCRIPTION OF THE INVENTION

According to the present invention, the developer with which a silver halide photosensitive material is treated contains a specific six-membered heterocyclic compound.

In the first aspect, the compound is of the general formula (I):

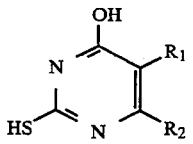

(I)

wherein $R_1$ and $R_2$ are independently selected from the group consisting of a hydrogen atom, halogen atom, alkyl, aryl, aralkyl, hydroxyl, mercapto, carboxyl, sulfo, phosphono, nitro, cyano, alkoxycarbonyl, aryloxycarbonyl, carbamoyl, sulfamoyl, and alkoxy group, the sum of carbon atoms in both $R_1$ and $R_2$ ranges from 2 to 20, and $R_1$ and $R_2$, taken together, may form a saturated ring structure.

In formula (I), $R_1$ and $R_2$ are independently selected from the group consisting of a hydrogen atom, halogen atom, alkyl, aryl, aralkyl, hydroxyl, mercapto, carboxy, sulfo, phosphono, nitro, cyano, alkoxycarbonyl, aryloxycarbonyl, carbamoyl, sulfamoyl, and alkoxy group. Among these groups, alkyl, aryl, aralkyl, alkoxycarbonyl, aryloxycarbonyl, carbamoyl, sulfamoyl and alkoxy groups may have a substituent which is as exemplified for $R_1$ and $R_2$. The sum of carbon atoms in both $R_1$ and $R_2$ ranges from 2 to 20. $R_1$ and $R_2$, taken together, may form a ring structure. Preferably, $R_1$ and $R_2$ are such that either one of $R_1$ and $R_2$ is a substituted or unsubstituted alkyl group having 1 to 10 carbon atoms, a substituted or unsubstituted aryl group having 6 to 12 carbon atoms, a substituted or unsubstituted aralkyl group having 7 to 12 carbon atoms, and a halogen atom. Also preferably, $R_1$ and $R_2$, taken together, form a saturated 5 or 6-membered ring. More preferably, $R_1$ is a hydrogen atom or an alkyl group having an amino group or heterocyclic ring as a substituent and $R_2$ is a substituted or unsubstituted alkyl group having 1 to 10 carbon atoms or a substituted or unsubstituted aryl group having 6 to 12 carbon atoms, or $R_1$ and $R_2$, taken together, form a saturated 5 or 6-membered ring. For example, $R_1$ is a dimethylamino-methyl, morpholinomethyl, N-methylpiperazinylmethyl or pyrrolidinylmethyl group and $R_2$ is a methyl, ethyl, phenyl or p-methoxyphenyl group.

Several illustrative, non-limiting examples of the six-membered heterocyclic compound of formula (I) are given below.

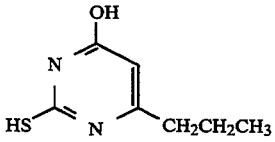

(1)

-continued

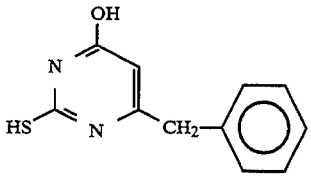

(2)

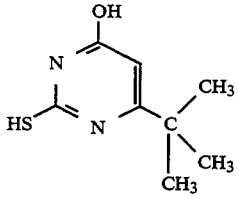

(3)

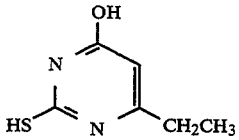

(4)

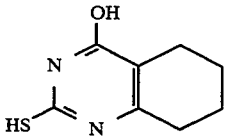

(5)

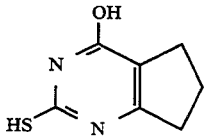

(6)

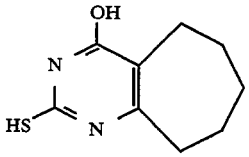

(7)

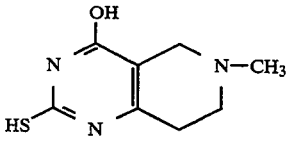

(8)

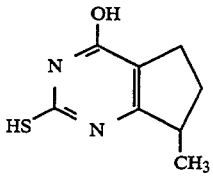

(9)

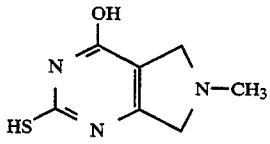

(10)

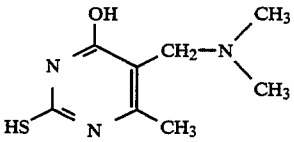

(11)

-continued (12)

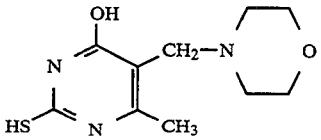

(13)

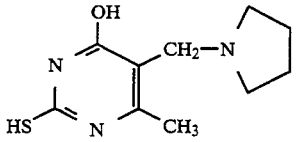

(14)

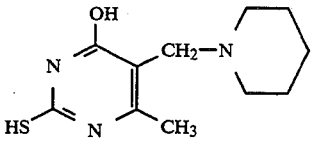

(15)

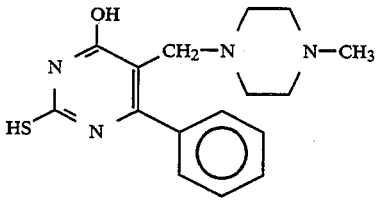

(16)

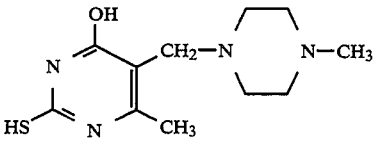

(17)

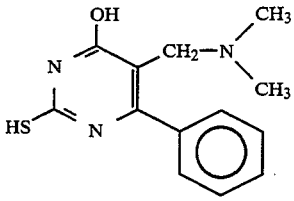

(18)

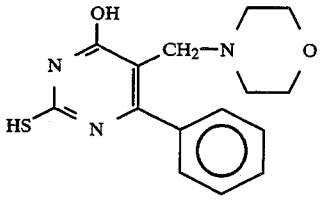

(19)

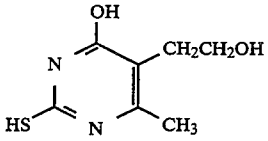

(20)

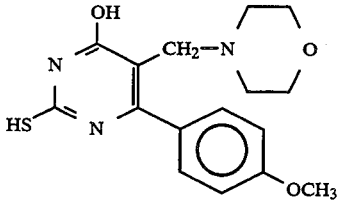

-continued (21)

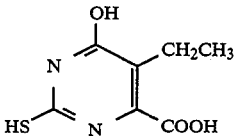

(22)

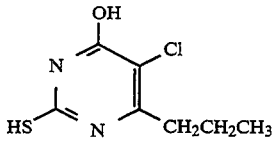

These 6-membered heterocyclic compounds of formula (I) may be readily synthesized by the methods described in Comprehensive Heterocyclic Chemistry, Volume 3, pages 40–56, 106–142, 179–191, and the Journal of American Chemical Society, Volume 67, 2197–2200 (1945).

The 6-membered heterocyclic compound of formula (I) is preferably added in an amount of about 0.01 to 5 grams, more preferably about 0.05 to 3 grams per liter of the developer.

It is known from JP-B 40339/1989 that good graininess and low fog are achievable by adding to a developer an anti-fogging compound of formula (IV) or (V):

(IV)

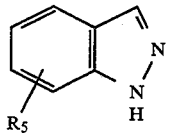

(V)

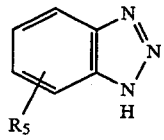

wherein $R_5$ is a hydrogen or halogen atom, or alkyl, nitro or cyano group. Examples of the compound of formula (IV) include indazole, 4-nitroindazole, 5-nitroindazole, 6-nitroindazole, 5-cyanoindazole, and 5-chloroindazole. Examples of the compound of formula (V) include benzotriazole, 5-methylbenzotriazole, 5-chlorobenzotriazole, and 5-bromobenzotriazole. Preferred are 5-nitroindazole and 5-methylbenzotriazole. These antifoggants are preferably added in amounts of 0.01 to 10 grams, more preferably 0.02 to 5 grams per liter of the developer.

A black-and-white developer containing a high concentration of sulfite causes silver to be dissolved from the photosensitive material into the developer as a silver sulfite complex. For preventing silver sludging, it is effective to reduce the amount of silver that can be dissolved from the photosensitive material into the developer. If the compound of formula (I) is used in large quantities, say, more than 5 grams, it will function as a fixing agent. Thus the amount of the compound of formula (I) added should be limited. We have found that the use of the compound of formula (I) in combination with the compound of formula (IV) or (V) is quite effective in reducing the amount of silver dissolved from a photosensitive material into a developer.

The developer composition of the present invention is characterized by containing the 6-membered heterocyclic compound of formula (I) . In one preferred embodiment, the developer is an alkaline aqueous solution which contains at least (a) a six-membered heterocyclic compound of formula (I) as defined above, (b) a dihydroxybenzene developing agent, (c) at least 0.3 mol/-liter of a free sulfite, and (d) at least one of 1-phenyl-3-pyrazolidone and aminophenol developing agents.

In the second aspect, a photosensitive material after exposure is treated with a developer containing a six-membered heterocyclic compound which has a six-membered ring containing three nitrogen atoms and has a mercapto group and a hydroxyl group. Preferably, the six-membered heterocyclic compound is of the general formula (II) or (III):

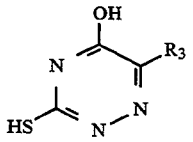

(II)

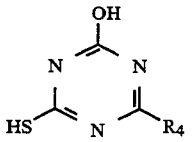

(III)

wherein $R_3$ and $R_4$ are independently selected from the group consisting of a hydrogen atom, halogen atom, alkyl, aryl, aralkyl, carboxyl, sulfo, phosphono, sulfoamino, nitro, cyano, alkoxycarbonyl, aryloxycarbonyl, carbamoyl, sulfamoyl, alkoxy, aryloxy, alkylthio, arylthio, and heterocyclic group.

In formula (II) or (III), $R_3$ and $R_4$ are independently selected from the group consisting of a hydrogen atom, halogen atom, alkyl, aryl, aralkyl, carboxy, sulfo, phosphono, sulfoamino, nitro, cyano, alkoxycarbonyl, aryloxycarbonyl, carbamoyl, sulfamoyl, alkoxy, aryloxy, alkylthio, arylthio, and heterocyclic group. Among these groups, alkyl, aryl, aralkyl, alkoxycarbonyl, aryloxycarbonyl, carbamoyl, sulfamoyl, alkoxy, aryloxy, alkylthio, arylthio, and heterocyclic groups may have a substituent which is as exemplified for $R_3$ and $R_4$. Preferred examples of the substituents $R_3$ and $R_4$ include hydrogen, substituted or unsubstituted alkyl groups having 1 to 10 carbon atoms, substituted or unsubstituted aryl groups having 6 to 12 carbon atoms, substituted or unsubstituted aralkyl groups having 7 to 12 carbon atoms, carboxyl, sulfo, sulfoamino, nitro and cyano groups, and halogen atoms. More preferably, $R_3$ and $R_4$ each are a hydrogen atom, an unsubstituted alkyl group having 1 to 6 carbon atoms, a substituted or unsubstituted aryl group having 6 to 10 carbon atoms, or a substituted or unsubstituted aralkyl group having 7 to 10 carbon atoms.

Several illustrative, non-limiting examples of the six-membered heterocyclic compound which has a six-membered ring containing three nitrogen atoms and has a mercapto group and a hydroxyl group are given below.

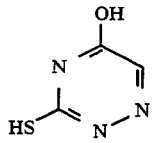

(51)

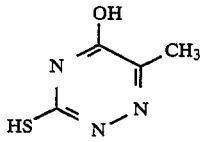

(52)

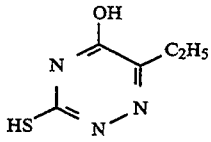

(53)

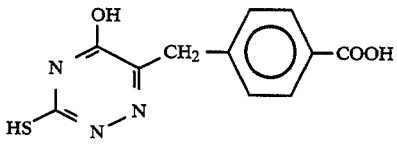

(54)

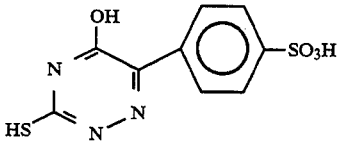

(55)

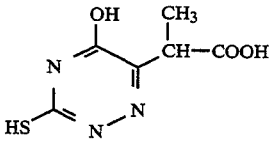

(56)

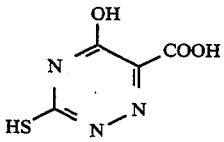

(57)

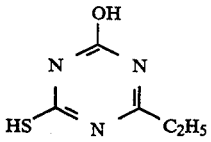

(58)

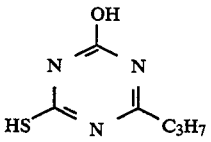

(59)

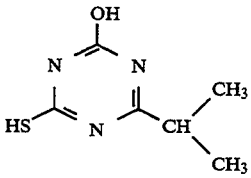

(60)

-continued
(61)
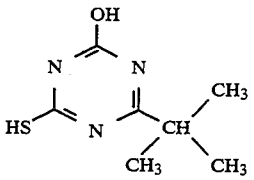
(62)
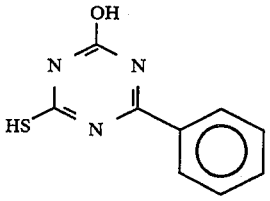
(63)
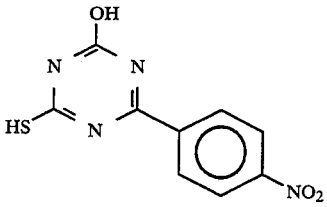
(64)
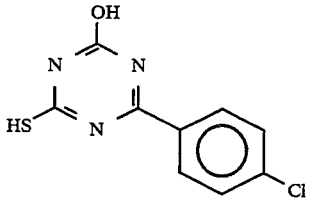
(65)
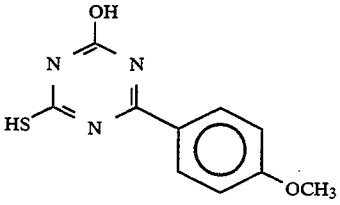
(66)
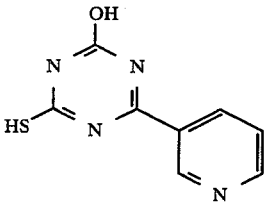
(67)
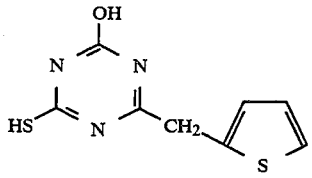
(68)
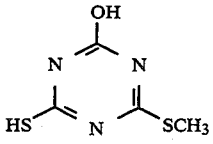
-continued
(69)
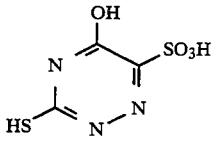
(70)
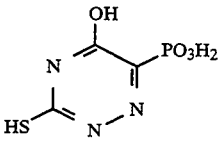
(71)
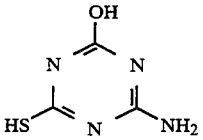
(72)
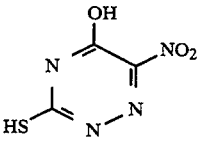
(73)
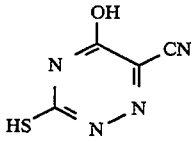
(74)
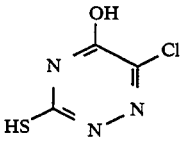
(75)
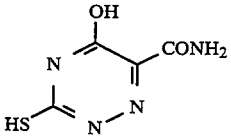
(76)
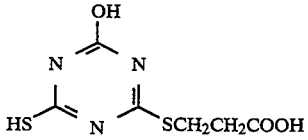
(77)
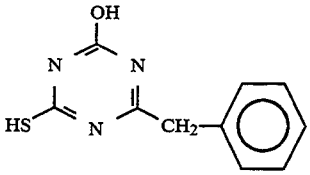
(78)
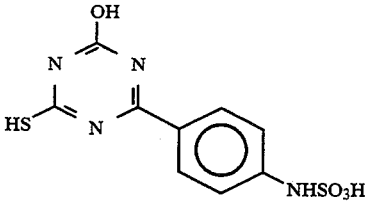

-continued (79)

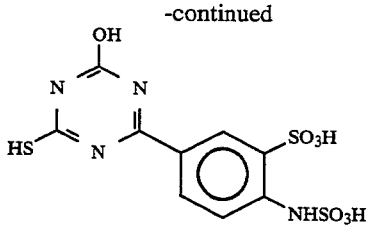

(80)

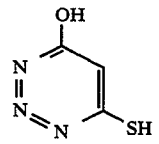

(81)

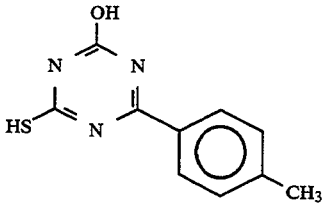

(82)

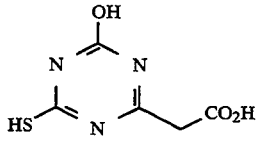

(83)

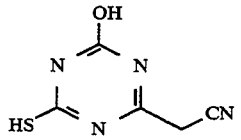

These 6-membered heterocyclic compounds may be readily synthesized by the methods described in Chemische Berichte, Volume 104, 1606–1610 (1971), the Journal of American Chemical Society, Volume 78, 1938–1941 (1956), and Angewandte Chemie, Volume 66, 359–363 (1954).

The 6-membered heterocyclic compound of formula (II) or (III) is preferably added in an amount of about 0.01 to 10 grams, more preferably about 0.05 to 5 grams per liter of the developer.

The developer of the present invention is characterized by containing the 6-membered heterocyclic compound which has a six-membered ring containing three nitrogen atoms and has a mercapto group and a hydroxyl group. In one preferred embodiment, the developer is an alkaline aqueous solution which contains at least (a') a six-membered heterocyclic compound as defined above, (b) a dihydroxybenzene developing agent, (c) at least 0.3 mol/liter of a free sulfite, and (d) at least one of 3-pyrazolidone and aminophenol developing agents.

Now, various components of the developer are described.

The dihydroxybenzene developing agents (b) used herein include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, and hydroquinone monosulfonate with the hydroquinone being preferred.

Examples of the p-aminophenol developing agent (d) used herein include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol, with the N-methyl-p-aminophenol being preferred.

Examples of the 3-pyrazolidone developing agent (d) used herein include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

The dihydroxybenzene developing agent is generally used in an amount of about 0.01 to 1.5 mol/liter, preferably about 0.05 to 1.2 mol/liter.

In addition to the dihydroxybenzene developing agent, the p-aminophenyl or 3-pyrazolidone developing agent is generally used in an amount of about 0.0005 to 0.2 mol/liter, preferably about 0.001 to 0.1 mol/liter.

The sulfite preservatives (c) in the developer according to the present invention include sodium sulfite, potassium sulfite, lithium sulfite, ammonium sulfite, sodium bisulfite, and potassium metabisulfite. The sulfite is used in an amount of at least about 0.3 mol/liter. The preferred upper limit is 2.5 mol/liter of developer concentrate.

The developer used herein is preferably at pH 9 to 13, more preferably pH 10 to 12.

Alkaline agents are used for pH adjustment. Included are pH adjusting agents such as sodium hydroxide, potassium hydroxide, sodium carbonate, potassium carbonate, sodium tertiary phosphate, and potassium tertiary phosphate.

Buffer agents are also useful, for example, borates as disclosed in JP-A 186259/1987, saccharose, acetoxime and 5-sulfosalicylic acid as disclosed in JP-A 93433/1985, phosphates, and carbonates.

Preferably in the practice of the invention, the developer further contains a chelating agent having a chelate stability constant of at least 8 relative to a ferric ion ($Fe^{3+}$). The term "stability constant" is well known in the literature, for example, L. G. Sillen and A. E. Martell, "Stability Constants of Metal Complexes", The Chemical Society, London (1964) and S. Chaberek and A. E. Martell, "Organic Sequestering Agents", Willey (1959).

The chelating agents having a stability constant of at least 8 relative to a ferric ion include organic carboxylic acid chelating agents, organic phosphoric acid chelating agents, inorganic phosphoric acid chelating agents, and polyhydroxy compounds. Illustrative, non-limiting examples include ethylenediaminedi-ortho-hydroxyphenylacetic acid, triethylenetetraaminehexaacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid (DTPA), hydroxyethyliminodiacetic acid, 1,3-diamino-2-propanoltetraacetic acid, trans-cyclohexanediaminetetraacetic acid, ethylenediaminetetraacetic acid (EDTA), glycoletherdiaminetetraacetic acid, ethylenediamine-N,N,-N',N'-tetrakismethylenephosphonic acid, nitrilo-N,N,N-trimethylenephosphonic acid, 1-hydroxyethylidene1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-disulfonic acid, sodium pyrophosphate, sodium tetrapolyphosphate, and sodium hexametaphosphate.

Also used in the developer is a dialdehyde hardening agent or a bisulfite salt adduct thereof, for example, glutaraldehyde or a bisulfate salt adduct thereof.

Additives used other than the above-mentioned components include development retarders such as sodium bromide, potassium bromide, and potassium iodide; organic solvents such as ethylene glycol, diethylene glycol, triethylene glycol, dimethylformamide, methyl cellosolve, hexylene glycol, ethanol, and methanol; and antifoggants, for example, mercapto compounds such as 1-phenyl-5-mercaptotetrazole and sodium 2-mercaptobenzimidazole-5-sulfonate, and indazole compounds such as 5-nitroindazole, and benzotriazole compounds such as 5-methylbenzotriazole. Also added are development promoters as disclosed in Research Disclosure, Vol. 176, No. 17643, Item XXI (December 1978), and if desired, color toning agents, surfactants, debubbling agents, and water softeners.

Anti-silver-sludging agents other than those of the present invention may be added to the developer in the practice of the present invention, for example, the compounds described in JP-A 24347/1981.

To the developer may be added amino compounds, for example, alkanol amines as described in EP-A 0136582, UK Pat. No. 958678, U.S. Pat. No. 3,232,761, and JP-A 106244/1981 for the purposes of promoting development and increasing contrast.

Other useful additives are described in L. F. A. Mason, "Photographic Processing Chemistry," Focal Press (1966), pages 226–229; U.S. Pat. Nos. 2,193,015 and 2,592,364, and JP-A 64933/1973.

In the practice of the invention, the above-mentioned development is followed by fixation using a fixer which is an aqueous solution containing a thiosulfate at pH 3.8 or higher, preferably pH 4.2 to 7.0.

The fixing agents include sodium thiosulfate and ammonium thiosulfate although the ammonium thiosulfate is preferred for fixing rate. The fixing agent is added in a varying amount, generally from about 0.1 to 6 mol/-liter.

The fixer may contain water soluble aluminum salts serving as a hardening agent, for example, aluminum chloride, aluminum sulfate, and potassium alum.

The fixer may contain tartaric acid, citric acid, gluconic acid or derivatives thereof alone or in admixture of two or more. These compounds are effectively added in an amount of at least 0.005 mol per liter of the fixer, especially 0.01 to 0.03 mol/liter.

If desired, the fixer may further contain preservatives (e.g., sulfites and bisulfites), pH buffer agents (e.g., acetic acid and boric acid), pH adjusting agents (e.g., sulfuric acid), chelating agents capable of softening hard water, and the compounds disclosed in JP-A 78551/1987.

Several terms are defined in conjunction with a sequence of successively processing a length or sheet of photosensitive material through a developing tank, a fixing tank, a washing tank, and then a drying section of an automatic processor. "Developing process time" or "developing time" is a duration taken from the point when the leading edge of a photosensitive material is dipped in the developing tank liquid in a processor to the point when it is subsequently dipped in the fixer. "Fixing time" is a duration taken from the point when the leading edge is dipped in the fixing tank liquid to the point when it is dipped in the washing tank liquid (or stabilizer). "Washing time" is a duration when the photosensitive material is dipped in the washing tank liquid. "Drying time" is a duration when the photosensitive material passes through the processor drying section where hot air at 35° to 100° C., preferably 40° to 80° C. is usually blown.

In the practice of the invention, the developing time generally ranges from 5 seconds to 1 minute, preferably from 5 to 30 seconds while the developing temperature ranges from 25° to 50° C., preferably from 25° to 40° C. The fixing time generally ranges from 5 seconds to 1 minute at a temperature of about 20° to 50° C., preferably from 5 to 30 seconds at a temperature of about 25° to 40° C. For water washing or stabilizing bath, the time generally ranges from 5 seconds to 1 minute at a temperature of 0° to 50° C., preferably from 5 to 30 seconds at a temperature of 15° to 40° C.

Having finished development, fixation and washing (or stabilization), the photosensitive material is removed of the wash water, that is, squeezed of water through squeeze rollers and then dried. Drying is generally at about 40° to 100° C. The drying time may vary with the ambient condition, usually in the range of from about 5 seconds to 1 minute, preferably from about 5 to 30 seconds at 40° to 80° C.

The photographic photosensitive materials which can be processed in the practice of the present invention include conventional black-and-white photosensitive materials and color photosensitive materials subject to a reversal process (e.g., color reversal film and paper). Particularly useful are laser printer photographic materials for recording medical images, graphic printing photosensitive materials, medical direct radiographic photosensitive materials, medical photofluorographic photosensitive materials, hydrazinė nucleating high contrast films, photosensitive materials for recording CRT display images, microphotographic photosensitive materials, general black-and-white negative films and print papers, and the like.

The photosensitive materials to which the present invention is applicable bear thereon a photographic silver halide emulsion. The emulsion is a dispersion of silver halides such as silver chloride, silver iodide, silver bromide, silver chlorobromide, silver iodobromide, and silver chloroiodobromide in hydrophilic colloid.

In general, silver halide emulsions are prepared by mixing water-soluble silver salts (e.g., silver nitrate) and water-soluble halides in the presence of water and hydrophilic colloid in accordance with conventional well-known techniques, for example, single jet, double jet, and controlled jet techniques, followed by physical ripening and chemical ripening such as gold and/or sulfur sensitization. No particular limit is imposed on the shape of silver halide grains used herein. Cubic, octahedral and spherical silver halide grains may be used as well as plate-shaped grains having a high aspect ratio as described in Research Disclosure, 22534 (January 1983).

In the case of X-ray sensitive material, emulsions of plate-shaped silver halide grains are advantageous. Preferred are silver bromide or silver iodobromide grains, with silver iodobromide grains containing up to 10 mol %, especially 0 to 5 mol % of silver iodide being most preferred for rapid processing because of high sensitivity.

The plate-shaped grains have an aspect ratio which is defined as a ratio of an average diameter of a circle having an equal area to the projected area of individual grains to an average thickness of individual grains. Preferably the plate-shaped grains have an aspect ratio of from 4 to less than 20, more preferably from 5 to 10 while the thickness is preferably up to 0.3 μm, especially up to 0.2 μm. Preferably the plate-shaped grains are present in an amount of at least 80% by weight, more preferably at least 90% by wight of the total weight of silver halide grains.

The use of plate-shaped silver halide grains not only helps achieve more stable photographic performance during running process according to the present invention, but also reduces the silver coverage, imposing less loads on fixing and drying steps which is advantageous for rapid processing.

With respect to plate-shaped silver halide grains, reference is made to Cugnac and Chateau, "Evolution of the Morphology of Silver Bromide Crystals during Physical Ripening", Science et Industrie Photography, Vol. 33, No. 2 (1962), pp. 121–125, Duffin "Photographic Emulsion Chemistry", Focal Press, New York, 1966, pp. 66–72, and A. P. H. Tribvlli & W. F. Smith, Photographic Journal, Vol. 80, p. 285 (1940). For their preparation, reference is made to JP-A 127921/1983, 113927/1983 and 113928/1983.

It is also possible to prepare plate-shaped silver halide grains by forming seed crystals containing more than 40% by weight of plate-shaped grains in an atmosphere having a relatively low pBr value, typically pBr≦1.3 and concurrently adding silver salt and halide solutions while maintaining the pBr value substantially unchanged, allowing the seed to growth. Desirably, silver salt and halide solutions are carefully added so that no crystal nuclei are newly generated during the grain growth process.

The dimensions of plate-shaped silver halide grains may be adjusted by adjusting the temperature, selecting the type and amount of solvent, and controlling the addition rate of silver salt and halide during grain growth.

The silver halide emulsion used herein may be either a multi-dispersed one or a mono-dispersed one having a narrow grain size distribution. Mono-dispersed emulsions having a dispersion coefficient of up to 20% are preferred for graphic printing photosensitive materials. By the term mono-dispersed emulsion is meant a silver halide emulsion having a grain size distribution with a coefficient of variation of up to 20%, especially up to 15%. The coefficient of variation is defined as (standard deviation of grain size)/(average of grain size)×100%.

The silver halide grains may have a uniform phase or different phases between the interior and the surface. Also useful is a mixture of two or more types of silver halide emulsions which are separated formed. The silver halide grains may ones in which a latent image is mainly formed at the surface or ones in which a latent image is mainly formed internally. Grains having a previously fogged surface are also acceptable.

In the silver halide emulsion used herein, a cadmium salt, sulfite salt, lead salt, thallium salt, rhodium salt or complex salt, and iridium salt or complex salt may be copresent during formation or physical ripening of silver halide grains. Particularly when it is desired to impart high contrast or to improve reciprocity low failure, it is preferred to prepare a silver halide emulsion while an iridium salt is present in an amount of $10^{-8}$ to $10^{-3}$ mol per mol of the silver halide. The silver halide emulsion used herein may also contain at least one of iron, rhenium, ruthenium, and osmium compounds in an amount of up to $10^{-3}$ mol, preferably $10^{-6}$ to $10^{-4}$ mol per mol of silver.

If necessary, the silver halide emulsion used herein may be chemically sensitized. Chemical sensitization may be effected by well-known methods such as sulfur, reduction and gold sensitization methods. Preferred is sulfur sensitization. The sulfur sensitizing agents include sulfur compounds contained in gelatin and various sulfur compounds, for example, thiosulfates, thioureas, thiazoles, and rhodanines. Exemplary compounds are described in U.S. Pat. Nos. 1,574,944, 2,278,947, 2,410,689, 2,728,668, 3,501,313, and 3,656,955. Preferred sulfur compounds are thiosulfates and thioureas. Chemical sensitization favors pAg 8.3 or lower, especially pAg 7.3 to 8.0. Satisfactory results are also obtained with the use of polyvinyl pyrrolidone in combination with a thiosulfate as reported by Moisar, Klein & Gelatione, Proc. Symp., 2nd, 301–309 (1970).

Gold sensitization is typical of noble metal sensitization methods and uses gold compounds, often gold complex salts. Also useful are complex salts of noble metals other than gold, such as platinum, palladium and iridium. Exemplary salts are described in U.S. Pat. No. 2,448,060 and UK Pat. No. 618,061.

The reduction sensitizing agents include stannous salts, amines, sulfinoformamidine, dialkylaminoborans, and silanes, examples of which are described in U.S. Pat. Nos. 2,487,850, 2,518,698, 2,694,637, 2,983,609 and 2,983,610.

Preferably, the silver halide grains used herein are spectrally sensitized with sensitizing dyes. The dyes used herein include cyanine dyes, merocyanine dyes, complex cyanine dyes, complex merocyanine dyes, holopolar cyanine dyes, hemicyanine dyes, styryl dyes, and hemioxonol dyes. Particularly useful dyes among them are cyanine, merocyanine, and complex merocyanine dyes. For these dyes, any nucleus generally utilized for cyanine dyes can be applied as a basic heterocyclic ring nucleus. Most preferred are carbocyanine sensitizing dyes. Specific examples are described in Research Disclosure, Vol. 170, RD-17643 (December 1978), page 23, U.S. Pat. Nos. 4,425,425 and 4,425,426.

In general, the sensitizing dye is added to the emulsion prior to its application to a suitable support although it may be added during chemical ripening step or silver halide grain forming step.

The emulsion layer of the photosensitive material used herein may contain plasticizers, for example, polymers such as alkyl acrylate latexes, emulsions thereof, and polyols such as trimethylol propane.

The photosensitive material used herein may further contain surfactants in its photographic emulsion layer or another hydrophilic colloid layer for the purposes of coating aid, antistatic, slippage improvement, emulsion dispersion, anti-sticking and photographic property improvement (e.g., development promotion, high contrast, and sensitization). Examples of the surfactant include nonionic surfactants, for example, saponins (steroids), alkylene oxide derivatives (e.g., polyethylene glycol, polyethylene glycol/polypropylene glycol condensates, polyethylene glycol alkyl ethers, polyethylene glycol alkyl aryl ethers, polyethylene glycol esters, polyethylene glycol sorbitan esters, polyalkylene glycol alkyl amines and amides, and polyethylene oxide adducts of silicones), glycidol derivatives (e.g., alkenyl succinic acid polyglycerides and alkylphenol polyglycerides), polyhydric alcohol fatty acid esters, and saccharide alkyl esters; anionic surfactants having an acidic group such as a carboxy, sulfo, phospho, sulfate or phosphate group, for example, alkyl carbonates, alkyl sulfonates, alkylbenzenesulfonates, alkylnaphthalene sulfonates, alkyl sulfates, alkyl phosphates, N-acyl-N-alkyltaurines, sulfosuccinate esters, sulfoalkylpolyoxyethylene alkylphenyl ethers, and polyoxyethylene alkylphosphate esters; ampholytic surfactants, for example, amic acids, aminoalkylsulfonates, aminoalkylsulfates and phosphates, alkylbetaines, and aminooxides; and cationic surfactants, for example, alkyl amine salts, aliphatic or aromatic quaternary ammonium salts, heterocyclic quaternary ammonium salts (e.g., pyridinium and imidazolium), and aliphatic or heterocyclic phosphonium and sulfonium salts.

In general, the photographic silver halide photosensitive material used herein has at least one silver halide emulsion layer on a support. In the case of medical direct radiographic photosensitive material, at least one silver halide emulsion layer is present on each side of a support as described in JP-A 111934/1983, 127921/1983, 90841/1984, and 201235/1986. 0 If desired, the photosensitive material used herein may have an intermediate layer, filter layer, and anti-halation layer.

In the photosensitive material used herein, the silver halide emulsion is preferably applied in an amount of 0.5 to 5 grams of silver/square meter of each surface, more preferably about 1 to 3 grams of silver/square meter of each surface. The upper limit of 5 $g/m^2$ of silver should not be exceeded for rapid processing ability. At least 0.5 $g/m^2$ of silver is necessary to provide a satisfactory image density and contrast.

The binder or protective colloid of the photographic emulsion is advantageously gelatin although other hydrophilic colloids may be used. Useful are synthetic hydrophilic high-molecular weight substances, for example, gelatin derivatives, graft polymers of gelatin and other polymers, protein hydroxyethyl celluloses such as albumin and casein, cellulose derivatives such as carboxymethyl cellulose and cellulose sulfate ester, sodium alginate, saccharide derivatives such as starch derivatives, and homopolymers and copolymers such as polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

The gelatin used may be lime treated gelatin, acid treated gelatin, hydrolyzed gelatin, or enzymatically decomposed gelatin.

It is preferred that the emulsion layer or another hydrophilic colloid layer contain an organic substance which will leach out during development step, especially in the case of X-ray sensitive material. Where the leachable substance is gelatin, a species of gelatin which does not participate in the crosslinking reaction of gelatin with a hardening agent is preferred. Examples include acetylated gelatin and phthalated gelatin, with those of lower molecular weight being preferred. High molecular weight substances other than gelatin include polyacrylamides as disclosed in U.S. Pat. No. 3,271,158, and hydrophilic polymers such as polyvinyl alcohol and polyvinyl pyrrolidone while saccharides such as dextran, saccharose, and pluran are also useful. Among these, polyacrylamides and dextran are preferred, with polyacrylamides being most preferred. These substances preferably have an average molecular weight of up to 20,000, more preferably up to 10,000. The amount of organic substance leached out during processing is from 10 to 50% of the total weight of the organic substance coated other than silver halide grains. Preferably 15 to 30% of the organic substance extinguishes during processing.

The layer containing the organic substance which can be leached out during processing may be an emulsion layer or a surface protective layer. If the total amount of the organic substance coated is fixed, it is preferred to distribute the organic substance in both the emulsion layer and the surface protective layer and more preferably solely in the surface protective layer rather than solely in the emulsion layer. Where the photosensitive material has a plurality of emulsion layers, it is preferred to add a higher proportion of the organic substance in an emulsion layer nearer to the surface protective layer if the total amount of the organic substance coated is fixed.

There may be contained matte agents, for example, organic compounds such as a homopolymer of polymethyl methacrylate, a copolymer of methyl methacrylate and methacrylic acid, and starch and inorganic compounds such as silica, titanium dioxide, strontium and barium sulfate, all in fine particulate form. The preferred particle size ranges from about 1.0 to 10 $\mu m$, especially from about 2 to 5 $\mu m$.

The photographic silver halide photosensitive material used herein may have a photographic emulsion layer or another layer colored with a dye for the purposes of absorbing a selected spectrum of light, that is, achieving halation or irradiation or providing a filter layer for controlling the spectrum of light to enter the photographic emulsion layer. In the case of double side films such as medical direct radiographic films, a layer for cutting crossover may be provided below the emulsion layer. Examples of the dye used for these purposes include oxonol dyes having a pyrazolone or barbituric acid nucleus, azo dyes, azomethine dyes, anthraquinone dyes, arylidene dyes, styryl dyes, triarylmethane dyes, merocyanine dyes, and cyanine dyes.

On use of such dyes, it is effective to mordant an anionic dye to a selected layer in the photosensitive material by using a polymer having a cation site. In this case, a dye which undergoes irreversible discoloration in the development-fixation-washing sequence is preferably used. The layer to which the dye is mordanted using a polymer having a cation site may be an emulsion layer, a surface protective layer, or a layer remote from the emulsion layer with respect to the support, but preferably a layer between the emulsion layer and the support. It is ideal to mordant an undercoat layer of medical X-ray double side film for crossover cutting purposes.

As coating aids in the undercoat layer may be used a nonionic surfactant of polyethylene oxide type in combination with a polymer having a cation site.

Preferably, the polymer having a cation site is selected from anion exchange polymers. Various well-known quaternary ammonium salt and phosphonium salt polymers are useful anion exchange polymers. The quaternary ammonium salt and phosphonium salt polymers are described in the following publications as mordant polymers and antistatic polymers. Examples include the water-dispersible latexes disclosed in JP-A 30328/1978, 92274/1979, 126027/1979, 155835/1979, 142339/1980, and 166940/1984 and U.S. Pat. No. 3,958,995; the polyvinyl pyridinium salts disclosed in U.S. Pat. Nos. 2,548,564, 3,148,061 and 3,756,814; the water-soluble quaternary ammonium salt polymers disclosed in U.S. Pat. No. 3,709,690; and the water-insoluble quaternary ammonium salt polymers disclosed in U.S. Pat. No. 3,898,088. On use, it is preferred to convert such a polymer latex into a water-soluble cross-linked polymer latex by copolymerizing it with a monomer having at least 2, preferably 2 to 4, ethylenically unsaturated groups in order to prevent the polymer latex from migrating from the selected layer to another layer or into the processing solution to exert a photographically undesirable influence. For fixing the dye, a solid dispersion method as disclosed in JP-A 155350/1980 and WO 88/04794 is also effective.

The photosensitive material used herein may be designed to exhibit ultrahigh contrast photographic properties using hydrazine nucleating agents. This system and hydrazine nucleating agents used are described in the following literature and patents.

Research Disclosure, Item 23516 (November 1983), page 346 and the literature cited therein;

U.S. Pat. Nos. 4,080,207, 4,269,929, 4,276,364, 4,278,748, 4,385,108, 4,459,347, 4,560,638, 4,478,928, 4,686,167;

UK Pat. No. 2,011,391B;

EP 217,310; and

JP-A 179734/1985, 170733/1986, 270744/1986, 000948/1987, 178246/1987, 270948/1987, 029751/1988, 032538/1988, 104047/1988, 121838/1988, 129337/1988, 223744/1988, 234244/1988, 234245/1988, 234246/1988, 294552/1988, 306438/1988, 010233/1989, 090439/1989, 276128/1989, 280747/1989, 283548/1989, 283549/1989, 285940/1989, 002541/1990, 139538/1990, 177057/1990, 198440/1990, 198441/1990, 198442/1990, 196234/1990, 196235/1990, 220042/1990, 221953/1990, 221954/1990.

The system is especially useful in graphic art.

The hydrazine nucleating agent is incorporated in a photographic photosensitive material, preferably into a silver halide emulsion layer or less preferably into another non-photosensitive hydrophilic colloid layer (e.g., protective layer, intermediate layer, filter layer, and anti-halation layers). The amount of hydrazine nucleating agent added preferably ranges from $1\times10^{-6}$ to $5\times10^{-2}$ mol, more preferably from $1\times10^{-5}$ to $2\times10^{-2}$ mol per mol of silver halide.

Development accelerators or agents for promoting nucleating transfer phenomenon useful for this ultrahigh contrast system are the compounds described in JP-A 077616/1978, 137133/1978, 037732/1979, 014959/1985, and 140340/1985, and various compounds containing an N or S atom. These accelerators are preferably added in an amount of $1.0\times10^{-3}$ to 0.5 g/m$^2$, more preferably $5.0\times10^{-3}$ to 0.1 g/m$^2$ although the optimum amount varies with the type of accelerator.

Additionally, the photosensitive material used herein may contain various additives for the purposes of preventing fog during preparation, shelf storage and photographic processing of the photosensitive material and stabilizing photographic performance. Useful additives include a number of compounds generally known as antifoggants and stabilizers, for example, azoles (e.g., benzothiazolium salts), nitroindazoles, chlorobenzimidazoles, bromobenzimidazoles, mercaptotetrazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds (e.g., oxazolinethion); azaindenes, for example, triazaindenes, tetraazaindenes (e.g., 4-hydroxy-substituted-(1,3,3a,7)-tetraazaindenes), and pentaazaindenes; benzenethiosulfonic acid, benzenesulfinic acid, and benzenesulfonic acid amide. Inter alia, benzotriazoles (e.g., 5-methylbenzotriazole) and nitroindazoles (e.g., 5-nitroindazole) are preferred. Alternatively, these compounds may be contained in processing solutions. Moreover, compounds which release retardants during development as described in JP-A 30243/1987 may be added as stabilizers or for black pepper inhibiting purpose.

Further, the photographic photosensitive material used herein may contain a developing agent such as hydroquinone derivatives and phenidone derivatives as a stabilizer or accelerator.

Also contained in the photographic photosensitive material used herein are organic or inorganic hardeners in a photographic emulsion layer or another hydrophilic colloid layer. Useful are chromium salts (e.g., chromium alum and chromium acetate), aldehydes (e.g., formaldehyde and glutaraldehyde), N-methylol compounds (e.g., dimethylol urea), dioxane derivatives, active vinyl compounds (e.g., 1,3,5-triacryloyl-hexahydro-s-triazine and 1,3-vinylsulfonyl-2-propanol), active halides (e.g., 2,4-dichloro-6-hydroxy-s-triazine), and mucohalogenic acids (e.g., mucochloric acid) alone or in admixture.

Also the photographic photosensitive material used herein may contain a hydroquinone derivative capable of releasing a development inhibitor in accordance with the density of an image during development (known as DIR-hydroquinones) in a photographic emulsion layer or another hydrophilic colloid layer. Useful examples are disclosed in U.S. Pat. Nos. 3,379,529, 3,620,746, 4,377,634, and 4,332,878, and JP-A 129536/1974, 067419/1979, 153336/1981, 153342/1981, 090435/1984, 090436/1984, 138808/1984, and 278853/1984.

For the purposes of dimensional stability, the photosensitive material used herein may contain dispersions of water-insoluble or difficultly soluble synthetic polymers. Useful polymers have monomer components such as alkyl (meth)acrylate, alkoxy acryl (meth)acrylate, glycidyl (meth)acrylate alone or in admixture thereof or in combination with acrylic acid and methacrylic acid.

Preferably, a compound having an acid group is contained in a silver halide emulsion layer or another layer of the photographic photosensitive material used herein. Examples of the compound having an acid group include organic acids such as salicylic acid, acetic acid, and ascorbic acid, and polymers and copolymers having a recurring unit of an acid monomer such as acrylic acid, maleic acid, and phthalic acid. For these compounds, reference is made to JP-A 223834/1986, 228437/1986, 025745/1987, and 055642/1987. Especially preferred among these compounds are ascorbic acid as a typical low-molecular weight compound and a water-dispersible latex of a copolymer between an acid monomer (e.g., acrylic acid) and a crosslinkable monomer having two or more unsaturated groups (e.g., divinyl benzene) as a typical high-molecular weight compound.

The silver halide emulsion thus prepared is applied to a suitable support such as cellulose acetate film and polyethylene terephthalate (PET) film by conventional coating techniques such as dipping, air knife, bead, extrusion doctor, and double coating techniques, followed by drying.

The present invention is also applicable to color photosensitive materials. In this case, a variety of color couplers are used. The color coupler used herein is a compound capable of coupling reaction with an oxidized form of an aromatic primary amine developing agent for forming a dye. Typical examples of the useful color coupler include naphthol and phenol compounds, pyrazolone and pyrazoloazole compounds, and open ring or heterocyclic ketomethylene compounds. Illustrative examples of the cyan, magenta and yellow couplers which can be used herein are described in Research Disclosure, RD 17643 (December 1978), item VII-D and RD 18716 (November 1979) and the patents cited therein.

A variety of photographic additives which can be used herein are described in RD 17643, pages 23–28 and RD 18716, pages 648–651. They are listed below together with the pages to be referred to in the literature. Letters R and L mean right and left columns of the page.

| Additive | RD17643 | RD18716 |
|---|---|---|
| 1. Chemical sensitizer | 23 | 648R |
| 2. Sensitivity increasing agent | 23 | 648R |
| 3. Spectral sensitizer/ Supersensitizer | 23–24 | 648R-649R |
| 4. Brightener | 24 | |
| 5. Antifoggant/stabilizer | 24–25 | 649R |
| 6. Light absorber/filter dye/ UV absorber | 25–26 | 649R-650L |
| 7. Anti-staining agent | 25R | 650L-R |
| 8. Dye image stabilizing agent | 25 | |
| 9. Hardener | 26 | 651L |
| 10. Binder | 26 | 651L |

EXAMPLE

Examples of the present invention are given below by way of illustration and not by way of limitation. In the examples, Mw is a molecular weight. The anti-sludging compounds of the invention are identified with the numbers in the chemical formula lists previously described.

Examples 1 to 6 demonstrate the effectiveness of compounds of formula (I).

Example 1

(1) Preparation of Plate-shaped Grains

To 1 liter of water in a container were added 4.5 grams of potassium bromide, 20.6 grams of gelatin, and 2.5 cc of an aqueous solution of 5% thioether $HO(CH_2)_2S(CH_2)_2S(CH_2)_2OH$. While the solution was kept at 60° C., with stirring, 37 cc of an aqueous silver nitrate solution (3.43 grams of silver nitrate) and 33 cc of an aqueous solution containing 2.97 grams of potassium bromide and 0.363 grams of potassium iodide were added to the container over 37 seconds by a double jet mixing method. Then, an aqueous solution containing 0.9 grams of potassium bromide was added and thereafter, the container was heated to 70° C. and 53 cc of an aqueous silver nitrate solution (4.90 grams of silver nitrate) was added over 13 minutes. To the container was added 15 cc of 25% aqueous ammonia. After 20 minutes of physical ripening at the temperature, 14 cc of a 100% acetic acid solution was added to the solution for neutralization. Subsequently, an aqueous solution containing 133.3 grams of silver nitrate and an aqueous potassium bromide solution were added to the solution over 35 minutes by a controlled double jet method while maintaining the solution potential at pAg 8.5. Then, 10 cc of a 2N potassium thiocyanate solution and 0.10 mol % based on the total silver content of AgI fine particles having a particle diameter of 0.07 μm were added. After physical ripening for 5 minutes at the temperature, the solution was cooled to a temperature of 35° C. There were obtained plate-shaped grains having a total silver iodide content of 0.36 mol %. The grains had an average projection area diameter of 1.05 μm and a thickness of 0.175 μm.

Thereafter, the soluble salts were removed by sedimentation. The temperature was raised to 40° C. again and 30 grams of gelatin and 2.35 grams of phenoxyethanol, and 0.8 grams of sodium polystyrenesulfonate as a thickener were added to the emulsion, which was adjusted to pH 5.90 and pAg 8.25 with sodium hydroxide and silver nitrate solutions.

The emulsion was subjected to chemical sensitization while it was maintained at 56° C. with stirring. First, 0.043 mg of thiourea dioxide was added and the emulsion was maintained for 22 minutes under these conditions for reduction sensitization. Thereafter, 20 mg of 4-hydroxy-6-methyl-1,3,3a,7-tetraazaindene and 500 mg of the following compound were added to the emulsion.

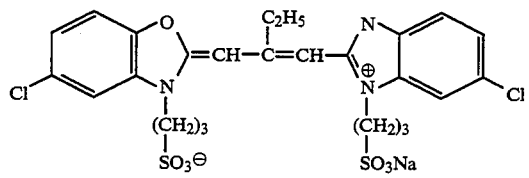

Additionally, 0.83 grams of calcium chloride was added. Subsequently, 3.3 mg of sodium thiosulfate, 2.6 mg of chloroauric acid, and 90 mg of potassium thiocyanate were added to the emulsion which was maintained for 40 minutes under the same conditions. Then the emulsion was cooled to 35° C.

The preparation of plate-shaped grains was completed in this way.

(2) Preparation of Emulsion Coating Composition

A coating composition was prepared by adding the following chemicals to the emulsion in the amounts reported per mol of silver halide in plate-shaped grain form.

| Chemical | Amount |
|---|---|
| 2,6-bis(hydroxyamino)-4-diethylamino-1,3,5-triazine | 72 mg |
| Gelatin | an amount to give a total coverage of 2.4 g/m$^2$ as combined with gelatin in the surface protective layer |
| Trimethylolpropane | 9 g |
| Dextran (average Mw 39,000) | 18.5 g |
| Sodium polystyrenesulfonate (average Mw 600,000) | 1.8 g |
| Hardener 1,2-bis(vinylsulfonyl-acetamide)ethane | an amount to provide a swelling factor of 230% |
| 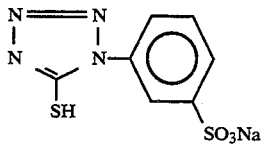 | 34 mg |

-continued

| Chemical | Amount |
|---|---|
| 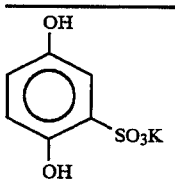 | 10 g |

(3) Preparation of Surface Protective Layer Coating Composition

The surface protective layer coating composition were prepared so as to form a surface protective layer consisting of the following components in the following coating weight.

| Component | Coating weight |
|---|---|
| Gelatin | 0.966 g/m$^2$ |
| Sodium polyacrylate (average Mw = 400,000) | 0.023 g/m$^2$ |
| 4-hydroxy-6-methyl-1,3,3a,7-tetraazaindene | 0.015 g/m$^2$ |
| 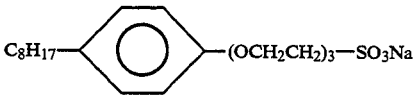 | 0.013 g/m$^2$ |
| $C_{16}H_{33}O-(CH_2CH_2O)_{10}-H$ | 0.045 g/m$^2$ |
| $C_{17}H_{33}CON(CH_3)CH_2CH_2SO_3Na$ | 0.0065 g/m$^2$ |
| $C_8F_{17}SO_2N(C_3H_7)-(CH_2CH_2O)_{15}-H$ | 0.003 g/m$^2$ |
| $C_8F_{17}SO_2N(C_3H_7)-(CH_2CH_2O)_4-(CH_2)_4-SO_3Na$ | 0.001 g/m$^2$ |
| Polymethyl methacrylate (mean particle size 3.7 μm) | 0.087 g/m$^2$ |
| Proxcel (adjusted to pH 7.4 with NaOH) | 0.0005 g/m$^2$ |

(4) Preparation of Support (4-1) Preparation of Dye for Undercoat Layer

The following dye was ball milled in accordance with the teaching of JP-A 197943/1988.

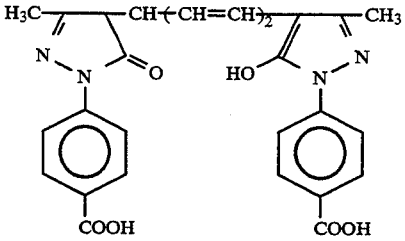

A ball mill was charged with 434 ml of water and 791 ml of an aqueous solution of 6.7% Triton X-200 surfactant (TX-200). To the mixed solution was added 20 grams of the dye. The mill was charged with 400 ml of zirconium oxide (ZrO) beads having a diameter of 2 mm and the contents were milled for 4 days. Then 160 grams of 12.5% gelatin was added to the mill. After debubbling, the ZrO beads were removed by filtration. The resulting dye dispersion was observed to find that the milled dye had a wide distribution of particle size ranging from 0.05 to 1.15 μm in diameter with a mean particle size of 0.37 μm. Coarse dye particles having a size of 0.9 μm or larger were centrifugally removed. There was obtained a dye dispersion.

(4-2) Preparation of Support

A biaxially oriented PET film of 183 μm thick was furnished. The PET film contained 0.04% by weight of a dye of the following structure.

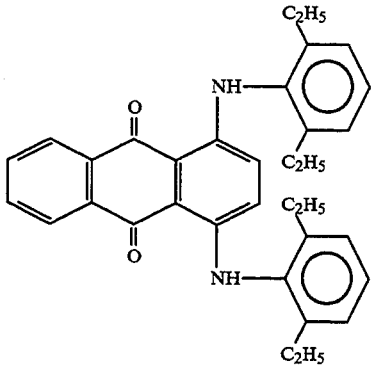

The film on one surface was treated with a corona discharge, coated with a first undercoat liquid of the following composition to a buildup of 5.1 cc/m$^2$ by means of a wire bar coater, and then dried for one minute at 175° C. Then, a first undercoat layer was similarly formed on the opposite surface of the film.

| First undercoat composition | |
|---|---|
| Butadiene-styrene copolymer latex solution* (solids 40%, butadiene/styrene weight ratio = 31/69) | 79 cc |
| 4% sodium 2,4-dichloro-6-hydroxy-s-triazine solution | 20.5 cc |
| Distilled water | 900.5 cc |

*The latex solution contained 0.4% by weight based on the latex solids of $nC_6H_{13}OOCCH(SO_3Na)CH_2$ as an emulsion dispersant.

Next, a second undercoat layer of the following composition was coated on each of the first undercoat layers on opposite surfaces of the film by means of a wire bar coater and then dried at 150° C.

| Second undercoat composition | Coating weight |
|---|---|
| Gelatin | 160 mg/m$^2$ |
| Dye dispersion | 26 mg/m$^2$ of dye solids |
| 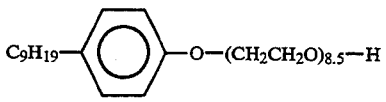 | 8 mg/m$^2$ |
| 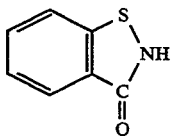 | 0.27 mg/m$^2$ |
| Matte agent, polymethyl methacrylate | 2.5 mg/m$^2$ |

-continued

| Second undercoat composition | Coating weight |
|---|---|
| (mean particle size 2.5 μm) | |

(5) Preparation of Photographic Material

The emulsion coating composition and the surface protective layer coating composition both formulated above were coated on each surface of the above-prepared support by a co-extrusion method. The amount of silver coated was 1.75 g/m$^2$ on each surface. The amounts of gelatin and hardener added to the emulsion layer were adjusted to provide a swelling factor of 230% as determined by a freeze dry method using liquefied nitrogen. A photographic material was obtained in this way.

(6) Preparation of Developer

There were prepared developer concentrate parts A, B and C and starter having the following compositions.

| Developer (diluted to 10 liters) | |
|---|---|
| Part A | |
| Diethylenetriamine pentaacetic acid | 20 g |
| Potassium hydroxide | 291 g |
| Potassium sulfite | 442 g |
| Sodium hydrogen carbonate | 75 g |
| Boric acid | 10 g |
| Hydroquinone | 300 g |
| Diethylene glycol | 120 g |
| 5-methylbenzotriazole | 0.2 g |
| Potassium bromide | 15 g |
| Water | totaling to 2.5 liters |
| Part B | |
| Triethylene glycol | 200 g |
| Glacial acetic acid | 40 g |
| 5-nitroindazole | 2.5 g |
| 1-phenyl-3-pyrazolidone | 15 g |
| Water | totaling to 250 ml |
| Part C | |
| Glutaraldehyde (50 wt %) | 100 g |
| Sodium metabisulfite | 126 g |
| Water | totaling to 250 ml |
| Starter | |
| Glacial acetic acid | 150 g |
| Potassium bromide | 300 g |
| Water | totaling to 1.5 liters |

A service solution was prepared by sequentially dissolving 2.5 liters of part A, 250 ml of part B and 250 ml of part C in about 6 liters of water with stirring, diluting the solution with water to 10 liters, and adjusting the pH to 10.40. This service solution is a developer replenisher. A tank developer was prepared by adding 20 ml of the starter to 1 liter of the developer replenisher.

For fixation, a fixer Fuji F (manufactured by Fuji Photo-Film Co., Ltd.) was used.

(7) Processing

Using a roller conveyor type automatic processor model FPM-9000 (manufactured by Fuji Photo-Film Co., Ltd.), the photographic material prepared in (5) was processed in the sequence of Table 1. This sequence is a rapid process of 45 seconds.

TABLE 1

| Step | Temp. | Time | Replenishment |
|---|---|---|---|
| Development | 35° C. | 14 sec. | 45 ml/10 × 12 inches |
| Fixation | 32° C. | 12 sec. | 60 ml/10 × 12 inches |
| Washing | — | 8 sec. | 3 l/min. |
| Squeeze/drying | — | 11 sec. | |
| Total | | 45 sec. | |

A series of runs used different developers which were prepared by adding anti-sludging agents to the developer replenisher formulated in (6) as shown in Table 2.

TABLE 2

| Developer No. | Composition |
|---|---|
| D101 (comparison) | developer replenisher (free of the compound of the invention) |
| D102 (comparison) | developer replenisher + 0.13 g/l of compound of JP-A 204037/1984 |
| D103 (invention) | developer replenisher + 0.17 g/l of Compound (1) of the invention |
| D104 (invention) | developer replenisher + 0.18 g/l of Compound (5) of the invention |
| D105 (invention) | developer replenisher + 0.17 g/l of Compound (6) of the invention |
| D106 (invention) | developer replenisher + 0.31 g/l of Compound (18) of the invention |

It is to be noted that the comparative compound is a compound having the following formula in JP-A 204037/1984.

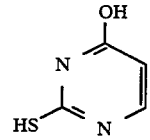

The processor was operated 6 days a week. On every operating day, 100 quarter size (10×12 inches) sheets of half-exposed photographic material were processed. This running process was continued over two weeks, with the accumulative number of processed sheets amounting to 1,200.

For evaluating the photographic properties of the photosensitive material by sensitometry, it was exposed stepwise through an optical wedge. The photographic properties examined are sensitivity (S), fog, average gradient (G), and maximum density (Dm). Sensitivity (S) is reported as a relative value on the basis that the reciprocal of an exposure required to provide a blackening degree of fog +1.0 is 100. Fog was determined as a net density increase with a correction for base density. Average gradient (G) is the gradient of a straight line connecting a density of fog +0.25 and a density of fog +2.0.

The results of the running test are shown in Table 3 together with the silver sludging observations. Test Nos. 101 to 106 correspond to developer Nos. D101 to D106, respectively.

TABLE 3

| Run No. | Test | Fresh | 600 sheets | 1200 sheets | Silver sludge in developer | Staingin of photosensitive material |
|---|---|---|---|---|---|---|
| 101* | Fog | 0.04 | 0.04 | 0.04 | from 500th sheet | stained |
| | G | 2.75 | 2.72 | 2.74 | | |
| | S | 100 | 101 | 103 | | |

TABLE 3-continued

| Run No. | Test | Fresh | 600 sheets | 1200 sheets | Silver sludge in developer | Staingin of photo-sensitive material |
|---|---|---|---|---|---|---|
| | Dm | 3.51 | 3.53 | 3.48 | | |
| 102* | Fog | 0.04 | 0.04 | 0.04 | from 600th sheet | stained |
| | G | 2.76 | 2.73 | 2.76 | | |
| | S | 99 | 100 | 98 | | |
| | Dm | 3.48 | 3.49 | 3.51 | | |
| 103 | Fog | 0.04 | 0.05 | 0.04 | no sludge | NO |
| | G | 2.72 | 2.73 | 2.76 | up to 2000 sheets | |
| | S | 99 | 97 | 98 | | |
| | Dm | 3.51 | 3.48 | 3.50 | | |
| 104 | Fog | 0.04 | 0.04 | 0.04 | no sludge | NO |
| | G | 2.73 | 2.71 | 2.74 | up to 2000 sheets | |
| | S | 98 | 99 | 96 | | |
| | Dm | 3.49 | 3.49 | 3.52 | | |
| 105 | Fog | 0.04 | 0.04 | 0.04 | no sludge | NO |
| | G | 2.81 | 2.79 | 2.78 | up to 2000 sheets | |
| | S | 98 | 101 | 102 | | |
| | Dm | 3.61 | 3.55 | 3.54 | | |
| 106 | Fog | 0.04 | 0.05 | 0.05 | no sludge | NO |
| | G | 2.74 | 2.75 | 2.77 | up to 2000 sheets | |
| | S | 97 | 101 | 100 | | |
| | Dm | 3.53 | 3.48 | 3.51 | | |

As seen from Table 3, test Nos. 101 and 102 using developers D101 and D102 were satisfactory in photographic properties, but quite unsatisfactory in silver sludging. Silver sludging caused the processor to be contaminated internally, imposing a heavy burden on the maintenance of the processor. Silver sludging also caused staining of photosensitive material, leaving a serious problem with respect to the management of image quality. In contrast, test Nos. 103 to 106 using developers D103 to D106 containing the anti-sludging agents according to the present invention were successful in minimizing silver sludging with little influence on photographic properties.

Example 2

(1) Preparation of AgI Fine Grains

To 2 liters of water were added 0.5 grams of potassium iodide and 26 grams of gelatin. To the solution at 35° C., 80 cc of an aqueous solution containing 40 grams of silver nitrate and 80 cc of an aqueous solution containing 39 grams of potassium iodide were added over 5 minutes with stirring. The flow rates of silver nitrate and potassium iodide solutions were both 8 cc/min. at the start of addition and linearly accelerated so that addition of each 80 cc was complete within 5 minutes.

After grains were formed in this way, the soluble salts were removed by sedimentation at 35° C. The dispersion was then heated to 40° C., combined with 10.5 grams of gelatin and 2.56 grams of phenoxyethanol, and adjusted to pH 6.8 with sodium hydroxide. There was obtained 730 grams of a mono-dispersed emulsion containing AgI fine grains having a mean particle diameter of 0.015 μm.

(2) Preparation of Plate-shaped Grains

To 1 liter of water in a container were added 4.5 grams of potassium bromide, 20.6 grams of gelatin, and 2.5 cc of an aqueous solution of 5% thioether $HO(CH_2)_2S(CH_2)_2S(CH_2)_2OH$. While the solution was kept at 60° C., with stirring, 37 cc of an aqueous silver nitrate solution (3.43 grams of silver nitrate) and 33 cc of an aqueous solution containing 2.97 grains of potassium bromide and 0.363 grams of potassium iodide were added to the container over 37 seconds by a double jet mixing method. Then, an aqueous solution containing 0.9 grams of potassium bromide was added and thereafter, the container was heated to 70° C. and 53 cc of an aqueous silver nitrate solution (4.90 grams of silver nitrate) was added over 13 minutes. To the container was added 15 cc of 25% aqueous ammonia. After 20 minutes of physical ripening at the temperature, 14 cc of a 100% acetic acid solution was added to the solution for neutralization. Subsequently, an aqueous solution containing 133.3 grams of silver nitrate and an aqueous potassium bromide solution were added to the solution over 35 minutes by a controlled double jet method while maintaining the solution potential at pAg 8.5. Then, 10 cc of a 2N potassium thiocyanate solution and 0.05 mol % based on the total silver content of AgI fine particles prepared in (1) were added. After physical ripening for 5 minutes at the temperature, the emulsion was cooled to a temperature of 35° C. There was obtained a monodispersion of plate-shaped grains having a total silver iodide content of 0.31 mol %, an average projection area diameter of 1.10 μm and a thickness of 0.165 μm, with a variation coefficient of diameter of 18.5%.

Thereafter, the soluble salts were removed by sedimentation. The temperature was raised to 40° C. again and 35 grams of gelatin and 2.35 grams of phenoxyethanol, and 0.8 grams of sodium polystyrenesulfonate as a thickener were added to the emulsion, which was adjusted to pH 5.90 and pAg 8.25 with sodium hydroxide and silver nitrate solutions.

The emulsion was subjected to chemical sensitization while it was maintained at 56° C. with stirring. First, 0.043 mg of thiourea dioxide was added and the emulsion was maintained for 22 minutes under these conditions for reduction sensitization. Thereafter, 20 mg of 4-hydroxy-6-methyl1,3,3a,7-tetraazaindene and 500 mg of the following compound were added to the emulsion.

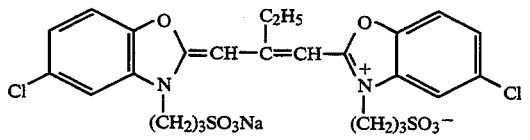

Additionally, 1.1 grams of calcium chloride aqueous solution was added. Subsequently, 3.3 mg of sodium thiosulfate, 2.6 mg of chloroauric acid, and 90 mg of potassium thiocyanate were added to the emulsion which was maintained for 40 minutes under the same conditions. Then the emulsion was cooled to 35° C.

The preparation of plate-shaped grains was completed in this way.

(3) Preparation of Emulsion Coating Composition

A coating composition was prepared by adding the following chemicals to the emulsion in the amounts reported per mol of silver halide.

| Chemical | Amount |
|---|---|
| 2,6-bis(hydroxyamino)-4-diethylamino-1,3,5-triazine | 72 mg |
| Gelatin | an amount to give a total coverage of 2.4 g/m$^2$ as combined with gelatin in the surface protective layer |
| Trimethylolpropane | 9 g |
| Dextran (average Mw 39,000) | 18.5 g |
| Sodium polystyrenesulfonate (average Mw 600,000) | 1.8 g |
| Hardener 1,2-bis(vinylsulfonyl-acetamide)ethane | an amount to provide a swelling factor of 200% |
| 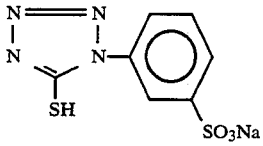 | 34 mg |
| 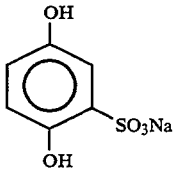 | 10.9 g |

(4) Preparation of Surface Protective Layer Coating Composition

The surface protective layer coating composition were prepared so as to form a surface protective layer consisting of the following components in the following coating weight.

| Component | Coating weight |
|---|---|
| Gelatin | 0.966 g/m$^2$ |
| Sodium polyacrylate (average Mw = 400,000) | 0.023 g/m$^2$ |
| 4-hydroxy-6-methyl-1,3,3a,7-tetraazaindene | 0.015 g/m$^2$ |
| 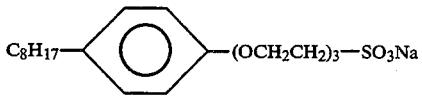 | 0.013 g/m$^2$ |
| $C_{16}H_{33}O-(CH_2CH_2O)_{10}-H$ | 0.045 g/m$^2$ |
| $C_{17}H_{33}CON(CH_3)CH_2CH_2SO_3Na$ | 0.0065 g/m$^2$ |
| $C_8F_{17}SO_2N(C_3H_7)-(CH_2CH_2O)_{15}-H$ | 0.003 g/m$^2$ |

-continued

| Component | Coating weight |
|---|---|
| $C_8F_{17}SO_2N(C_3H_7)-(CH_2CH_2O)_4-(CH_2)_4-SO_3Na$ | 0.001 g/m$^2$ |
| Polymethyl methacrylate (mean particle size 3.7 μm) | 0.087 g/m$^2$ |
| Proxcel (adjusted to pH 6.4 with NaOH) | 0.0005 g/m$^2$ |

(5) Preparation of Support (5-1) Preparation of Dye For Undercoat Layer

The following dye was ball milled in accordance with the teaching of JP-A 197943/1988.

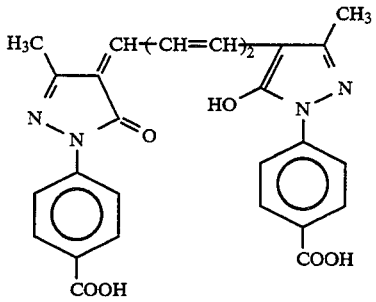

A ball mill was charged with 434 ml of water and 791 ml of an aqueous solution of 6.7% Triton X-200 surfactant (TX-200). To the mixed solution was added 20 rams of the dye. The mill was charged with 400 ml of zirconium oxide (ZrO) beads having a diameter of 2 mm and the contents were milled for 4 days. Then 160 grams of 12.5% gelatin was added to the mill. After debubbling, the ZrO beads were removed by filtration. The resulting dye dispersion was observed to find that the milled dye had a wide distribution of particle size ranging from 0.05 to 1.15 μm in diameter with a mean particle size of 0.37 μm. Coarse dye particles having a size of 0.9 μm or larger were centrifugally removed. There was obtained a dye dispersion.

(5-2) Preparation of Support

A biaxially oriented PET film of 183 μm thick was furnished. The PET film contained 0.04% by weight of a dye of the following structure.

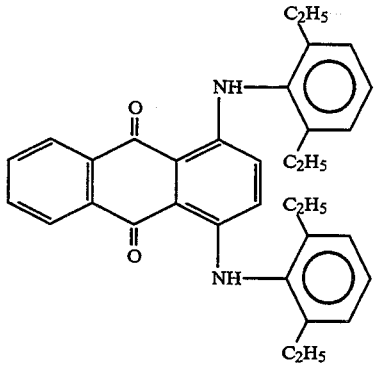

The film on one surface was treated with a corona discharge, coated with a first undercoat liquid of the following composition to a buildup of 5.1 cc/m$^2$ by means of a wire bar coater, and then dried for one minute at 175° C. Then, a first undercoat layer was similarly formed on the opposite surface of the film.

| First undercoat composition | |
|---|---|
| Butadiene-styrene copolymer latex solution* (solids 40%, butadiene/styrene weight ratio = 31/69) | 79 cc |
| 4% sodium 2,4-dichloro-6-hydroxy-s-triazine solution | 20.5 cc |
| Distilled water | 900.5 cc |

*The latex solution contained 0.4% by weight based on the latex solids of dihexyl 2-sulfosuccinate:

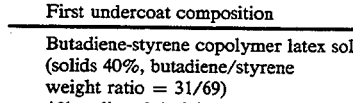

$nC_6H_{13}OOCCH_2$
|
$nC_6H_{13}OOCCH—SO_3Na$ as an emulsion dispersant.

Next, a second undercoat layer of the following composition was coated on each of the first undercoat layers on opposite surfaces of the film by means of a wire bar coater and then dried at 150° C.

| Second undercoat composition | Coating weight |
|---|---|
| Gelatin | 160 mg/m² |
| Dye dispersion | 26 mg/m² of dye solids |
| 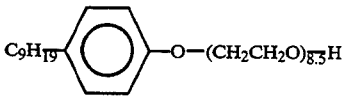 | 8 mg/m² |
| 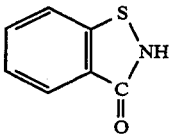 | 0.27 mg/m² |
| Matte agent, polymethyl methacrylate (mean particle size 2.5 μm) | 25 mg/m² |

(6) Preparation of Photographic Material

The emulsion coating composition and the surface protective layer coating composition both formulated above were coated on each surface of the above-prepared support by a co-extrusion method. The amount of silver coated was 1.7 g/m² on each surface. A photographic material was obtained in this way.

The photographic material was allowed to stand for 7 days at 25° C. and RH 60% before the swelling factor of the hydrophilic colloid layer was measured. The thickness (a) of a dry film was determined by observing a cut section under a scanning electron microscope (SEM). The thickness (b) of a swollen film was determined by dipping the photographic material in distilled water at 21° C. for 3 minutes, freeze drying it with liquefied nitrogen, and observing it under SEM. The swelling factor was calculated to be 225% in accordance with $(b-a)/a \times 100\%$.

(7) Preparation of Developer

There were prepared a developer concentrate and a fixer concentrate having the following composition.

| Develper concentrate (diluted by a factor of 2.5) | |
|---|---|
| Potassium hydroxide | 43 g |
| Sodium sulfite | 100 g |
| Potassium sulfite | 126 g |
| Diethylenetriaminepentaacetic acid | 5 g |
| Boric acid | 20 g |
| Hydroquinone | 85 g |

-continued

| Develper concentrate (diluted by a factor of 2.5) | |
|---|---|
| 4-hydroxymethyl-4-methyl-1-phenyl-3-pyrazolidone | 15 g |
| Diethylene glycol | 30 g |
| 5-methylbenzotriazole | 0.2 g |
| Potassium bromide | 10 g |
| Water | totaling to 1 liter pH 10.65 |

A service solution was prepared by diluting 400 ml of the developer concentrate with 600 ml of water and adjusting to pH 10.35.

| Fixer concentrate (diluted by a factor of 4) | |
|---|---|
| Ammonium thiosulfate | 500 g |
| Disodium EDTA dihydrate | 0.1 g |
| Sodium thiosulfate pentahydrate | 50 g |
| Sodium sulfite | 60 g |
| Sodium hydroxide | 25 g |
| Acetic acid | 100 g |
| Water | totaling to 1 liter pH 5.1 |

A service solution was prepared by diluting 250 ml of the fixer concentrate with 750 ml of water and adjusting to pH 5.0.

(8) Processing

A running test was carried out as in Example 1. Using a roller conveyor type automatic processor having an overall path length of 1950 mm, the photographic material prepared in (6) was processed with the developer (service solution) and then the fixer (service solution) in the sequence of Table 4. This sequence is a rapid process of 30 seconds.

TABLE 4

| Step | Temp. | Time | Replenishment |
|---|---|---|---|
| Development | 35° C. | 9 sec. | 25 ml/10 × 12 inches |
| Fixation | 32° C. | 7 sec. | 25 ml/10 × 12 inches |
| Washing | 20° C. | 5 sec. | 3 l/min. |
| Squeeze/drying | 55° C. | 9 sec. | |
| Total | | 30 sec. | |

Running tests were carried out in the 30-second processing sequence using developers containing Compounds (1), (2), (5), (6), (12), (13), (15), (18) and (20) of the invention. Outstanding improvements in silver sludging were achieved as in Example 1 without substantial influence on photographic properties.

Example 3

(1) Preparation of Silver Halide Emulsion

In a container, 40 grams of gelatin was dissolved in 1 liter of water. The container was heated at 53° C. and charged with 6 grams of sodium chloride, 0.4 grams of potassium bromide, and 60 mg of the following compound.

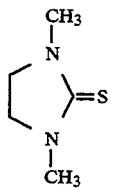

Then 600 ml of an aqueous solution containing 100 grams of silver nitrate and 600 ml of an aqueous solution containing 56 grams of potassium bromide and 7 grams of sodium chloride were added to the solution by a double jet mixing method, forming core grains containing 20 mol % of silver chloride. Thereafter, 500 ml of an aqueous solution containing 100 grams of silver nitrate and 500 ml of an aqueous solution containing 40 grams of potassium bromide, 14 grams of sodium chloride and $10^{-7}$ mol/mol of silver of potassium hexachloroiridate (III) were further added to the solution by a double jet mixing method, forming a shell containing 40 mol % of silver chloride around the cores. There was obtained a monodispersion of cubic silver chlorobromide grains of the core/shell type having a mean grain size of 0.35 μm.

After salt removal, the dispersion was combined with 40 grams of gelatin, adjusted to pH 6.0 and pAg 8.5, and then chemically sensitized at 60° C. with 2 mg of triethylthiourea, 4 mg of chloroauric acid and 0.2 grams of 4-hydroxy-6-methyl-1,3,3a,7-tetraazaindene.

(2) Preparation of Emulsion Coating Composition

An emulsion coating composition was prepared by heating 850 grams of the emulsion at 40° C. and adding the following additives thereto.

| Emulsion coating composition | |
|---|---|
| Emulsion | 850 g |
| Spectral sensitizing dye* | $1.2 \times 10^{-4}$ mol |
| Supersensitizer* | $0.8 \times 10^{-3}$ mol |
| Storage modifier* | $1 \times 10^{-3}$ mol |
| Polyacrylamide (Mw 40,000) | 7.5 g |
| Trimethylolpropane | 1.6 g |
| Sodium polystyrenesulfonate | 2.4 g |
| Poly(ethyl acrylate/ methacrylic acid) latex | 16 g |
| N,N'-ethylene-bis(vinylsulfonacetamide) | 1.2 g |

*These components are of the following structures.

Spectral sensitizing dye

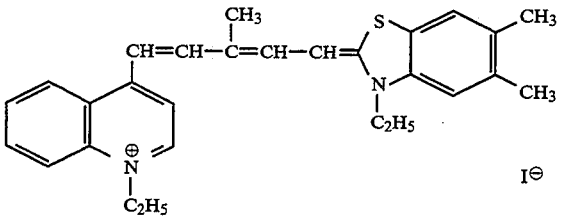

Supersensitizer

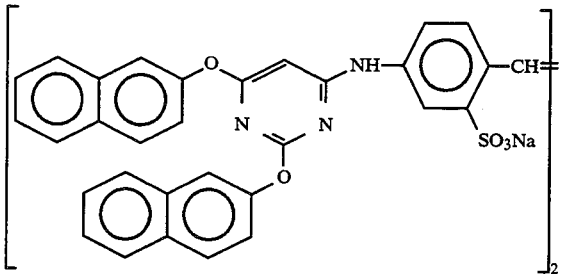

Storage modifier

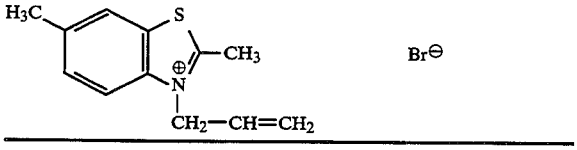

(3) Preparation of Surface Protective Layer Coating Composition on Emulsion Layer A container was heated at 40° C. and charged with the following components to formulate a coating composition for forming a surface protective layer on the emulsion layer.

| Surface protective layer coating composition | |
|---|---|
| Gelatin | 100 g |
| Polyacrylamide (Mw 40,000) | 10 g |
| Sodium polystyrenesulfonate (Mw 600,000) | 0.6 g |
| N,N'-ethylene-bis(vinylsulfonacetamide) | 1.5 g |
| Polymethyl methacrylate fine particles (mean particle size 2.0 μm) | 2.2 g |
| Sodium t-octylphenoxyethoxyethanesulfonate | 1.2 g |
| $C_{16}H_{33}O-(CH_2CH_2O)_{10}-H$ | 2.7 g |
| Sodium polyacrylate | 4 g |
| $C_8F_{17}SO_3K$ | 70 mg |
| $C_8F_{17}SO_2N(C_3H_7)(CH_2CH_2O)_4(CH_2)_4-SO_3Na$ | 70 mg |
| NaOH (1N) | 4 ml |
| Methanol | 60 ml |

(4) Preparation of Back Layer Coating Composition

A container was heated at 40° C. and charged with the following components to formulate a coating composition for forming a back layer.

| Back layer coating composition | |
|---|---|
| Gelatin | 80 g |
| Dye* | 3.1 g |
| Sodium polystyrenesulfonate | 0.6 g |
| Poly(ethyl acrylate/ methacrylic acid) latex | 15 g |
| N,N'-ethylene-bis(vinylsulfonacetamide) | 4.3 g |

*The dye is of the following structure.

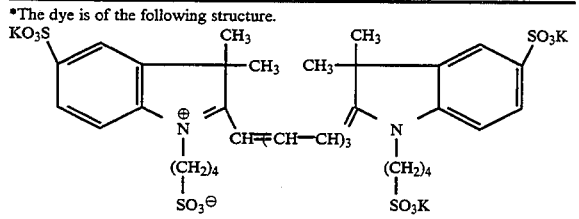

(5) Preparation of Surface Protective Layer Coating Composition on Back Layer

A container was heated at 40° C. and charged with the following components to formulate a coating composition for forming a surface protective layer on the back layer.

| Surface protective layer coating composition | |
|---|---|
| Gelatin | 80 g |
| Sodium polystyrenesulfonate | 0.3 g |
| N,N'-ethylene-bis(vinylsulfonacetamide) | 1.7 g |
| Polymethyl methacrylate fine particles (mean particle size 4.0 μm) | 4 g |
| Sodium t-octylphenoxyethoxyethanesulfonate | 3.6 g |
| NaOH (1N) | 6 ml |
| Sodium polyacrylate | 2 g |
| $C_{16}H_{33}O-(CH_2CH_2O)_{10}-H$ | 3.6 g |
| $C_8F_{17}SO_3K$ | 50 mg |
| $C_8F_{17}SO_2N(C_3H_7)(CH_2CH_2O)_4(CH_2)_4-SO_3Na$ | 50 mg |
| Methanol | 130 ml |

(6) Preparation of Photosensitive Material

A PET support on one surface was coated with the back layer coating composition and the back layer surface protective layer coating composition so as to provide an overall gelatin coverage of 3 g/m². The support on the opposite surface was coated with the emulsion layer coating composition and the emulsion layer surface protective layer coating composition so as to provide a silver coverage of 2.5 g/m$^2$ and a surface protective layer gelatin coverage of 1 g/m$^2$.

(7) Processing

Using the photosensitive material prepared in (6), a running test was carried out as in Example 1. A roller conveyor type automatic processor model FPM-200 (manufactured by Fuji Photo-Film Co., Ltd.) was modified so as to complete overall processing within 30 seconds on a dry-to-dry basis as shown in Table 5. In a photographic test, the photosensitive material was allowed to stand at 25° C. and RH 60% for 7 days and subjected to scanning exposure of $10^{-7}$ second at room temperature using semiconductor laser of 780 nm.

TABLE 5

| Step | Temp. | Time | Replenishment |
|---|---|---|---|
| Development | 35° C. | 7 sec. | 20 ml/10 × 12 inches |
| Fixation | 32° C. | 7 sec. | 20 ml/10 × 12 inches |
| Washing | 20° C. | 4 sec. | 3 l/min. |
| Squeeze/drying | 55° C. | 12 sec. | |
| Total | | 30 sec. | |

Twelve developers were prepared from the developer (service solution) used in Example 2 by adding the compounds within the scope of the present invention and comparative compounds 1 to 5 identified below in the amounts shown in Table 6.

Comparative compound 1 (JP-A 204037/1984)

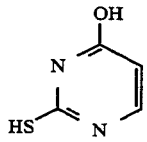

Comparative compound 2 (JP-B 35493/1973)

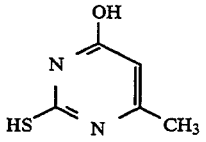

Comparative compound 3 (U.S. Pat. No. 3,597,199)

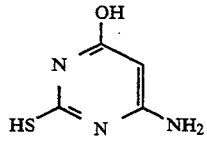

Comparative compound 4 (UKP 1,296,161)

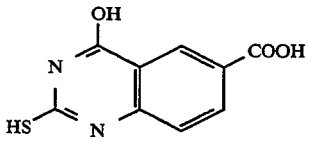

Comparative compound 5 (JP-A 121854/1989)

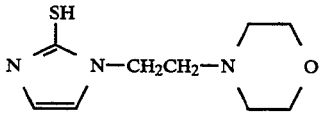

TABLE 6

| Developer No. | Composition |
|---|---|
| D301 (comparison) | developer replenisher (free of the compound of the invention) |
| D302 (comparison) | developer replenisher + 0.13 g/l of comparative compound 1 |
| D303 (comparison) | developer replenisher + 0.14 g/l of comparative compound 2 |
| D304 (comparison) | developer replenisher + 0.14 g/l of comparative compound 3 |
| D305 (comparison) | developer replenisher + 0.22 g/l of comparative compound 4 |
| D306 (comparison) | developer replenisher + 0.21 g/l of comparative compound 5 |
| D307 (invention) | developer replenisher + 0.17 g/l of Compound (1) of the invention |
| D308 (invention) | developer replenisher + 0.16 g/l of Compound (4) of the invention |
| D309 (invention) | developer replenisher + 0.18 g/l of Compound (5) of the invention |
| D310 (invention) | developer replenisher + 0.17 g/l of Compound (6) of the invention |
| D311 (invention) | developer replenisher + 0.32 g/l of Compound (15) of the invention |
| D312 (invention) | developer replenisher + 0.31 g/l of Compound (18) of the invention |

The processor was operated 6 days a week. On every operating day, 200 quarter size (10×12 inches) sheets of exposed photographic material were processed. This running process was continued over two weeks, with the accumulative number of processed sheets amounting to 2,400. The fixer used was the same as in Example 2. Both the developer and fixer were replenished in an amount of 20 ml per 10×12 inches.

For evaluating the photographic properties of the photosensitive material by sensitometry, it was exposed and examined for sensitivity (S), fog, average gradient (G), and maximum density (Dm) as in Example 1.

The results of the running test are shown in Table 7 together with the silver sludging observations. Test Nos. 301 to 312 correspond to developer Nos. D301 to D312, respectively.

TABLE 7

| Run No. | Test | Fresh | 2400 sheets | Silver sludge in developer | Staining of photo-sensitive material |
|---|---|---|---|---|---|
| 301* | Fog | 0.04 | 0.04 | from 300th sheet | stained |
| | G | 2.75 | 2.70 | | |
| | S | 100 | 99 | | |
| | Dm | 3.51 | 3.47 | | |
| 302* | Fog | 0.04 | 0.05 | from 400th sheet | stained |
| | G | 2.72 | 2.69 | | |
| | S | 99 | 97 | | |
| | Dm | 3.48 | 3.44 | | |
| 303* | Fog | 0.04 | 0.04 | from 600th sheet | NO |
| | G | 2.72 | 2.67 | | |
| | S | 100 | 99 | | |
| | Dm | 3.51 | 3.53 | | |
| 304* | Fog | 0.04 | 0.05 | from 300th sheet | stained |
| | G | 2.68 | 2.69 | | |
| | S | 98 | 99 | | |
| | Dm | 3.49 | 3.49 | | |
| 305* | Fog | 0.04 | 0.04 | from 500th sheet | stained |
| | G | 2.77 | 2.79 | | |
| | S | 100 | 101 | | |
| | Dm | 3.61 | 3.59 | | |
| 306* | Fog | 0.04 | 0.05 | from 250th sheet | stained |
| | G | 2.74 | 2.75 | | |
| | S | 97 | 96 | | |
| | Dm | 3.50 | 3.44 | | |
| 307 | Fog | 0.04 | 0.04 | from 2000th sheet | NO |
| | G | 2.71 | 2.72 | | |
| | S | 101 | 98 | | |
| | Dm | 3.55 | 3.53 | | |
| 308 | Fog | 0.04 | 0.05 | from 1500th sheet | NO |
| | G | 2.71 | 2.67 | | |
| | S | 97 | 96 | | |
| | Dm | 3.49 | 3.48 | | |
| 309 | Fog | 0.04 | 0.04 | no sludge | NO |
| | G | 2.75 | 2.71 | up to 2400 sheets | |
| | S | 99 | 97 | | |
| | Dm | 3.57 | 3.54 | | |
| 310 | Fog | 0.04 | 0.04 | no sludge | NO |

TABLE 7-continued

| Run No. | Test | Fresh | 2400 sheets | Silver sludge in developer | Staining of photo-sensitive material |
|---|---|---|---|---|---|
| | G | 2.69 | 2.68 | up to 2400 sheets | |
| | S | 97 | 97 | | |
| | Dm | 3.48 | 3.50 | | |
| 311 | Fog | 0.04 | 0.04 | no sludge | NO |
| | G | 2.72 | 2.73 | up to 2400 sheets | |
| | S | 100 | 99 | | |
| | Dm | 3.57 | 3.55 | | |
| 312 | Fog | 0.04 | 0.04 | no sludge | NO |
| | G | 2.74 | 2.74 | up to 2400 sheets | |
| | S | 98 | 97 | | |
| | Dm | 3.55 | 3.53 | | |

In the running test Nos. 307 to 312 using developers having compounds within the scope of the invention added thereto, silver sludge deposition was markedly reduced without substantial influence on photographic properties. Surprisingly, it was found that among mercaptopyrimidine compounds, the degree of silver sludging largely varies with the type of substituent.

Quite unexpectedly, when the photosensitive material was treated with developers having the compounds of the invention added thereto, the resulting image silver had an improved degree of blackness. With the developer free of the compound of the invention (run No. 301), the image silver was tinted yellow, presenting an unpleasant impression to a viewer. This is probably due to a small grain size. The present invention is successful in overcoming the image tone problem.

Example 4

The photosensitive material prepared in Example 3 was processed on a 30 second schedule by means of the same processor as used in Example 3 for examining photographic properties and the tone of developed silver images. Several developers were prepared from the developer (service solution) used in Example 2 by adding thereto anti-sludging agents, Compounds (1), (3), (5), (6) and (19) of the invention. The fixer used was the same as in Example 2. The results are shown in Table 8.

TABLE 8

| Run No. | Invention compound in developer | Fog | G | S | Dm | Developed silver image Tone | Evaluation |
|---|---|---|---|---|---|---|---|
| 401* | none | 0.04 | 2.70 | 100 | 3.51 | yellowish black | NO |
| 402 | 0.17 g/l compound (1) | 0.04 | 2.68 | 99 | 3.52 | neutral black | OK |
| 403 | 0.18 g/l compound (3) | 0.04 | 2.71 | 98 | 3.52 | neutral black | OK |
| 404 | 0.18 g/l compound (5) | 0.04 | 2.72 | 102 | 3.49 | neutral black | OK |
| 405 | 0.17 g/l compound (6) | 0.04 | 2.71 | 101 | 3.55 | neutral black | OK |
| 406 | 0.19 g/l compound (19) | 0.04 | 2.75 | 101 | 3.52 | neutral black | OK |

As seen from Table 8, run Nos. 402 to 406 with the developers containing the anti-sludging agents of the invention achieved a marked improvement in silver image without substantial influence on photographic properties. The tone of a silver image was favorably improved in that it was free of yellowness and had pure black tone finish.

Example 5

(1) Preparation of Emulsion

An emulsion was prepared as follows.

Part 1

-continued

| | |
|---|---|
| Water | 1.0 liter |
| Gelatin | 20 g |
| Sodium chloride | 20 g |
| 1,3-dimethylimidazoline-2-thion | 20 mg |
| Sodium benzenesulfonate | 8 mg |
| Part 2 | |
| Water | 400 ml |
| Silver nitrate | 100 g |
| Part 3 | |
| Water | 400 ml |
| Sodium chloride | 27.1 g |
| Potassium bromide | 21 g |
| Potassium hexachloroiridate (III) (0.001% aqueous solution) | 15 ml |
| Potassium hexabromorhodate (III) (0.001% aqueous solution) | 1.5 ml |
| Part 4 | |
| Water | 400 ml |
| Silver nitrate | 100 g |
| Part 5 | |
| Water | 400 ml |
| Sodium chloride | 27.1 g |
| Potassium bromide | 21 g |
| Potassium hexacyanoferrate (III) (0.1% aqueous solution) | 5 ml |

With stirring, Parts 2 and 3 were concurrently added over 10 minutes to Part 1 maintained at 38° C. and pH 4.5, forming nucleus grains of 0.16 μm. Subsequently, Parts 4 and 5 were concurrently added over 10 minutes to the solution. Grain formation was completed by further adding 0.15 grams of potassium iodide.

Then, the emulsion was washed with water by flocculation in a conventional manner, combined with gelatin, adjusted to pH 5.1 and pAg 7.5, and subjected to ortho-sensitization by adding an ortho-sensitizing dye of the following formula.

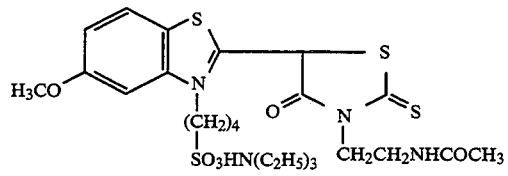

Thereafter, by adding 8 mg of sodium thiosulfate and 12 mg of chloroauric acid, the emulsion was chemically sensitized at 65° C. for achieving optimum sensitivity. To the emulsion were added 200 mg of 4-hydroxy-6-methyl-1,3,3a,7-tetraazaindene as a stabilizer and phenoxyethanol as a preservative. Finally obtained was an emulsion of cubic silver iodochlorobromide grains containing 70 mol % of silver chloride and having a mean grain size of 0.2 μm (coefficient of variation 9%).

(2) Preparation of Photosensitive Material

An emulsion coating composition was prepared by adding to the emulsion 2.5 grams per mol of Ag of hydroquinone and 50 mg per mol of Ag of 1-phenyl-5-mercaptotetrazole as anti-foggants, a polyethyl acrylate latex as a plasticizer in an amount of 25% based on the gelatin binder, 2-bis(vinylsulfonylacetamide)ethane as a hardener, and colloidal silica in an amount of 40% based on the gelatin binder. The emulsion coating composition was applied to a polyester support so as to provide a coverage: 3.0 g/m$^2$ of silver and 1.0 g/m$^2$ of gelatin.

On the emulsion layer, lower and upper protective layers of the following compositions were coated at the same time.

| | |
|---|---|
| Lower protective layer | |
| Gelatin | 0.25 g/m$^2$ |
| Sodium benzenethiosulfonate | 4 mg/m$^2$ |
| 1,5-dihydroxy-2-benzaldoxime | 25 mg/m$^2$ |
| Polyethyl acrylate latex | 125 mg/m$^2$ |
| Upper protective layer | |
| Gelatin | 0.25 g/m$^2$ |
| Silica matter agent (average grain size 2.5 μm) | 50 mg/m$^2$ |
| Silicone fluid | 30 mg/m$^2$ |
| Colloidal silica (grain size 10–20 μm) | 30 mg/m$^2$ |
| $C_8H_{17}SO_2N(C_3H_7)CH_2COOK$ | 5 mg/m$^2$ |
| Sodium dodecylbenzenesulfonate | 22 mg/m$^2$ |

The base support was also coated with a back layer and a back protective layer of the following compositions.

| | |
|---|---|
| Back layer | |
| Sodium dodecylbenzenesulfonate | 80 mg/m$^2$ |
| Compound SOK-1* | 70 mg/m$^2$ |
| Compound SOK-2* | 85 mg/m$^2$ |
| Compound SOK-3* | 90 mg/m$^2$ |
| 1,3-divinylsulfone-2-propanol | 60 mg/m$^2$ |

*SOK-1

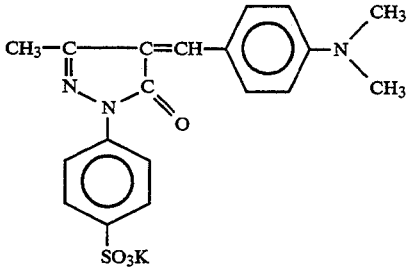

SOK-2

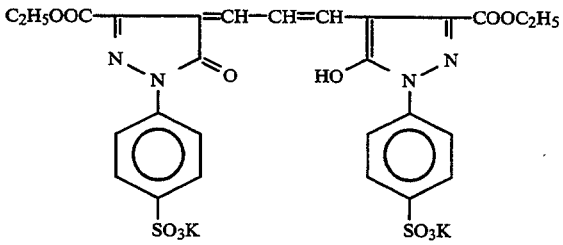

SOK-3

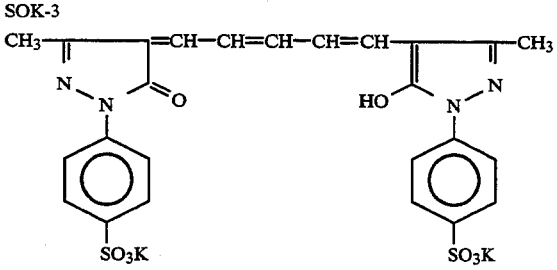

-continued

| | |
|---|---|
| Back protective layer | |
| Gelatin | 0.5 g/m$^2$ |
| Polymethyl methacrylate (grain size 4.7 μm) | 30 mg/m$^2$ |
| Sodium dodecylbenzenesulfonate | 20 mg/m$^2$ |
| $C_8H_{17}SO_2N(C_3H_7)CH_2COOK$ | 2 mg/m$^2$ |
| Silicone fluid | 100 mg/m$^2$ |

(3) Processing

There was prepared a developer of the following composition.

| | |
|---|---|
| Developer | |
| 1-hydroxy-ethylidene-1,1-diphosphonic acid | 2.0 g |
| Diethylenetriaminepentaacetic acid | 2.0 g |
| Sodium carbonate | 10.0 g |
| Potassium sulfite | 100.0 g |
| Potassium bromide | 10.0 g |
| Diethylene glycol | 20.0 g |
| 5-methylbenzotriazole | 0.2 g |
| Hydroquinone | 46.0 g |
| 4-hydroxymethyl-4-methyl-1-phenyl-3-pyrazolidone | 1.0 g |
| Water | totaling to 1 liter |
| Potassium hydroxide | pH adjusted to 10.7 |

Twelve test developers were prepared by adding anti-sludging agents to the developer as shown in Table 10. The comparative compounds are as identified in Example 3.

TABLE 9

| Developer No. | Composition |
|---|---|
| D501 (comparison) | developer replenisher (free of the compound of the invention) |
| D502 (comparison) | developer replenisher + 0.13 g/l of comparative compound 1 |
| D503 (comparison) | developer replenisher + 0.14 g/l of comparative compound 2 |
| D504 (comparison) | developer replenisher + 0.14 g/l of comparative compound 3 |
| D505 (comparison) | developer replenisher + 0.22 g/l of comparative compound 4 |
| D506 (comparison) | developer replenisher + 0.21 g/l of comparative compound 5 |
| D507 (invention) | developer replenisher + 0.18 g/l of Compound (5) of the invention |
| D508 (invention) | developer replenisher + 0.17 g/l of Compound (6) of the invention |
| D509 (invention) | developer replenisher + 0.24 g/l of Compound (12) of the invention |
| D510 (invention) | developer replenisher + 0.23 g/l of Compound (13) of the invention |
| D511 (invention) | developer replenisher + 0.32 g/l of Compound (15) of the invention |
| D512 (invention) | developer replenisher + 0.31 g/l of Compound (18) of the invention |

The photosensitive material prepared in (2) was exposed to a xenon flash lamp for a flashing time of $10^{-6}$ sec. through an interference filter having a peak at 488 nm and a continuous wedge. Using an automatic processor model FG-710 NH (manufactured by Fuji Photo-Film Co., Ltd.), the photosensitive material was subjected to a running test under the following conditions.

| Step | Temp. | Time |
|---|---|---|
| Development | 38° C. | 14 sec. |
| Fixation | 37° C. | 9.7 sec. |
| Washing | 26° C. | 9 sec. |

-continued

| Step | Temp. | Time |
|---|---|---|
| Squeezing | | 2.4 sec. |
| Drying | 55° C. | 8.3 sec. |
| Total | | 43.4 sec. |

The running test included the following conditions. On every operating day, 200 full-size (50.8 cm×61 cm) sheets of film were processed. This running process was continued over two weeks, with the accumulative number of processed sheets amounting to 2,400. The developer was replenished in an amount of 50 ml per full-size sheet.

For fixation was used a fixer LF-308 (manufactured by Fuji Photo-Film Co., Ltd.). It was replenished in an amount of 100 ml per full-size sheet.

The photosensitive material processed was examined for photographic properties by sensitometry. The photographic properties examined are fog, average gradient (G), sensitivity (S), and maximum density (Din). Average gradient (G) is the difference between density 3.0 and density 1.0 divided by the difference between the logarithm of an exposure providing density 3.0 and the logarithm of an exposure providing density 0.1. Sensitivity (S) is reported as a relative value on the basis that the reciprocal of an exposure required to provide a density of 1.5 when the photosensitive material is treated with fresh developer D501 is 100.

The results of the running test are shown in Table 10 together with the silver sludging observations. Test Nos. 501 to 512 correspond to developer Nos. D501 to D512, respectively.

TABLE 10

| Run No. | Test | Fresh | 2400 sheets | Silver sludge in developer | Staining of photosensitive material |
|---|---|---|---|---|---|
| 501* | Fog | 0.04 | 0.04 | from 250th | stained |
| | G | 6.00 | 6.02 | sheet | |
| | S | 100 | 101 | | |
| | Dm | 5.10 | 5.06 | | |
| 502* | Fog | 0.04 | 0.04 | from 300th | stained |
| | G | 5.80 | 5.85 | sheet | |
| | S | 98 | 99 | | |
| | Dm | 5.05 | 5.07 | | |
| 503* | Fog | 0.04 | 0.04 | from 600th | NO |
| | G | 5.82 | 5.85 | sheet | |
| | S | 98 | 101 | | |
| | Dm | 5.08 | 5.10 | | |
| 504* | Fog | 0.04 | 0.04 | from 200th | stained |
| | G | 5.90 | 5.84 | sheet | |
| | S | 97 | 98 | | |
| | Dm | 5.10 | 5.02 | | |
| 505* | Fog | 0.04 | 0.05 | from 300th | stained |
| | G | 5.95 | 5.90 | sheet | |
| | S | 100 | 98 | | |
| | Dm | 5.03 | 5.01 | | |
| 506* | Fog | 0.04 | 0.04 | from 200th | stained |
| | G | 5.80 | 5.79 | sheet | |
| | S | 98 | 97 | | |
| | Dm | 5.00 | 5.01 | | |
| 507 | Fog | 0.04 | 0.04 | no sludge | NO |
| | G | 5.90 | 5.89 | up to 2400 | |
| | S | 100 | 99 | sheets | |
| | Dm | 5.03 | 5.01 | | |
| 508 | Fog | 0.04 | 0.04 | no sludge | NO |
| | G | 5.87 | 5.85 | up to 2400 | |
| | S | 98 | 99 | sheets | |
| | Dm | 5.09 | 5.06 | | |
| 509 | Fog | 0.04 | 0.04 | no sludge | NO |
| | G | 5.89 | 5.92 | up to 2400 | |
| | S | 100 | 101 | sheets | |
| | Dm | 5.02 | 5.01 | | |
| 510 | Fog | 0.04 | 0.04 | no sludge | NO |
| | G | 5.99 | 5.92 | up to 2400 | |
| | S | 98 | 97 | sheets | |
| | Dm | 5.02 | 5.03 | | |
| 511 | Fog | 0.04 | 0.04 | no sludge | NO |
| | G | 5.85 | 5.81 | up to 2400 | |
| | S | 97 | 98 | sheets | |
| | Dm | 5.01 | 5.00 | | |
| 512 | Fog | 0.04 | 0.04 | no sludge | NO |
| | G | 5.98 | 5.92 | up to 2400 | |
| | S | 97 | 98 | sheets | |
| | Dm | 5.08 | 5.00 | | |

As seen from Table 10, run Nos. 501 to 506 using developers D501 to D506 were satisfactory in photographic properties, but quite unsatisfactory in silver sludging. Silver sludging caused the processor to be contaminated internally, imposing a heavy burden on the processor maintenance. Silver sludging also caused staining of photosensitive material, leaving a serious problem with respect to the management of image quality. In contrast, test Nos. 507 to 512 using developers D507 to D512 containing the anti-sludging agents according to the present invention were successful in minimizing silver sludging with little influence on photographic properties.

Example 6

First Photosensitive Emulsion Layer

Preparation of Photosensitive Emulsion A

With stirring, an aqueous solution of 0.37M silver nitrate and a silver halide aqueous solution containing $1\times10^{-7}$ mol of $(NH_4)_3RhCl_6$, $5\times10^{-7}$ mol of $K_3IrCl_6$, 0.11 mol of potassium bromide and 0.27 mol of sodium chloride per mol of silver were added to an aqueous gelatin solution containing sodium chloride and 1,3-dimethyl-2-imidazolidinethion at 45° C. over 12 minutes by a double jet method. There were obtained silver chlorobromide grains having a mean grain size of 0.20 μm and a silver chloride content of 70 mol % which served as nuclei. Thereafter, similarly, an aqueous solution of 0.63M silver nitrate and a silver halide aqueous solution containing 0.19 mol of potassium bromide and 0.47 mol of sodium chloride were added to the emulsion over 20 minutes by a double jet method. Then, a solution containing $1\times10^{-3}$ mol of KI was added to the emulsion for conversion. The emulsion was washed with water by flocculation in a conventional manner, combined with 40 grams of gelatin, and adjusted to pH 6.5 and pAg 7.5. Then 5 mg of sodium thiosulfate, 8 mg of chloroauric acid and 7 mg of sodium benzenethiosulfonate per mol of silver were added to the emulsion which was heated to 60° C. for 45 minutes for chemical sensitization. To the emulsion were added 150 mg of 1,3,3a,7-tetraazaindene as a stabilizer, proxcel and phenoxyethanol. There were obtained cubic silver chlorobromide grains having a silver chloride content of 70 mol % and a mean grain size of 0.28 μm (coefficient of variation 9%).

Coating of First Emulsion Layer

To photosensitive emulsion A were added $1\times10^{-3}$ mol per mol of Ag of 5-[3-(4-sulfobutyl)-5-chloro-2-benzoxazolidylidene]-1-hydroxyethoxyethyl-3-(2-pyridyl)-2-thiohydantoin as a sensitizing dye, $2\times10^{-4}$ mol of 1-phenyl-5-mercaptotetrazole, $5\times10^{-4}$ mol of a short-wavelength cyanine dye of the following structure, 200 mg/m² of a polymer of the following structure, 50 mg/m² of hydroquinone, 200 mg/m² of a polyethyl acrylate dispersion, 200 mg/m² of 1,3-bisvinylsulfonyl-2-propanol as a hardener, and $2.8\times10^{-5}$ mol/m² of a hydrazine compound of the following structure. The resulting emulsion was coated on a support to a coverage: 3.6 g/m² of silver and 2.0 g/m² of gelatin.

Cyanine dye

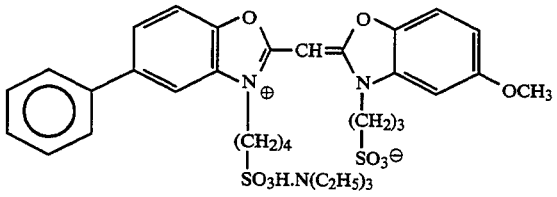

Polymer

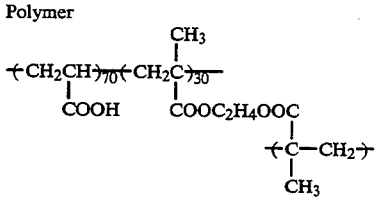

Hydrazine

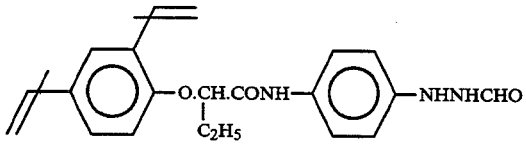

| Coating of intermediate layer | |
|---|---|
| Gelatin | 1.0 g/m² |
| 1,3-bisvinylsulfonyl-2-propanol | 4.0 wt % based on gelatin |

Second Photosensitive Emulsion Layer

Preparation of Photosensitive Emulsion B

With stirring, an aqueous solution of 1.0M silver nitrate and a silver halide aqueous solution containing $3\times10^{-7}$ mol of $(NH_4)_3RhCl_6$, 0.3 mol of potassium bromide and 0.74 mol of sodium chloride per mol of silver were added to an aqueous gelatin solution containing sodium chloride and 1,3-dimethyl-2-imidazolidinethion at 45° C. over 30 minutes by a double jet method. There were obtained silver chlorobromide grains having a mean grain size of 0.28 μm and a silver chloride content of 70 mol %. The emulsion was then washed with water by flocculation in a conventional manner, combined with 40 grams of gelatin, and adjusted to pH 6.5 and pAg 7.5. Then 5 mg of sodium thiosulfate and 8 mg of chloroauric acid per mol of silver were added to the emulsion which was heated to 60° C. for 60 minutes for chemical sensitization. To the emulsion was added 150 mg of 1,3,3a,7-tetraazaindene as a stabilizer. There were obtained cubic silver chlorobromide grains having a silver chloride content of 70 mol % and a mean grain size of 0.28 μm (coefficient of variation 10%).

Coating of Second Emulsion Layer

Photosensitive emulsion B was dissolved again, and $1.0\times10^{-3}$ mol per mol of silver of 5-[3-(4-sulfobutyl)-5-chloro-2 -benzoxazolidylidene]-1-hydroxyethoxyethyl-3-(2-pyridyl)-2-thiohydantoin as a sensitizing dye and a solution containing $1.0\times10^{-3}$ mol of KI were added thereto at 40° C. Further added were $2\times10^{-4}$ mol of 1-phenyl-5-mercaptotetrazole, 50 mg/m² of a polyethyl acrylate dispersion, 4.0 wt % based on the gelatin of 1,3-bisvinylsulfonyl-2-propanol as a hardener, and $1.0\times10^{-4}$ mol/m² of a redox compound of the following structure. The resulting emulsion was coated over the first emulsion layer to a coverage: 0.4 g/m² of silver and 0.5 g/m² of gelatin.

Redox compound

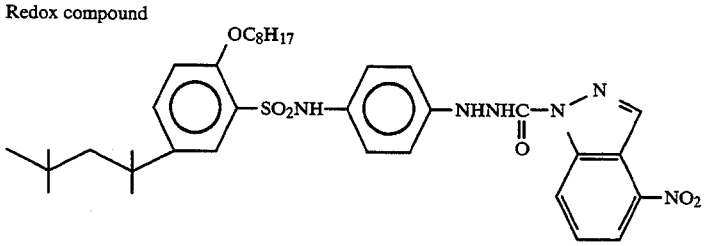

Coating of Protective Layer

A protective layer was coated on the second emulsion layer using a composition containing 0.5 g/m² of gelatin, 0.3 g/m² of polymethyl methacrylate particles (mean particle size 2.5 μm) and the following surfactants.

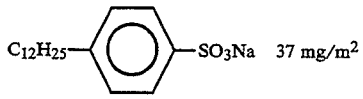

$C_{12}H_{25}$—$SO_3Na$ 37 mg/m²

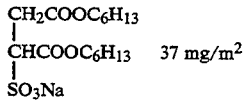

$CH_2COOC_6H_{13}$
$CHCOOC_6H_{13}$ 37 mg/m²
$SO_3Na$

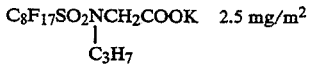

$C_8F_{17}SO_2NCH_2COOK$ 2.5 mg/m²
$C_3H_7$

A polyester film support of 100 μm thick was simultaneously coated with the first photosensitive emulsion layer as the lowermost layer, the intermediate layer, the second photosensitive emulsion layer, and the protective layer.

The support on the opposite surface was coated with a back layer and a back protective layer.

| Back layer | |
|---|---|
| Gelatin | 3 g/m² |
| Latex: polyethyl acrylate | 2 g/m² |
| Surfactant: sodium p-dodecylbenzenesulfonate | 40 mg/m² |
| Gelatin hardener: | 110 mg/m² |

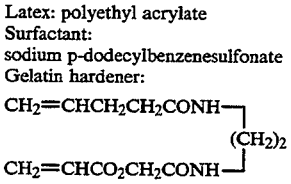

$CH_2{=}CHCH_2CH_2CONH$
$(CH_2)_2$
$CH_2{=}CHCO_2CH_2CONH$

-continued

Dye: a mixture of dyes [a], [b] and [c]

Dye [a] 50 mg/m²

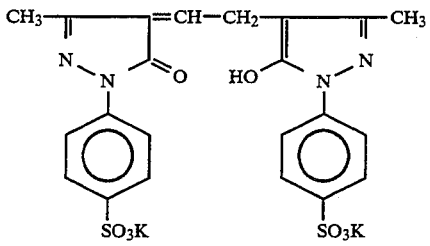

Dye [b] 100 mg/m²

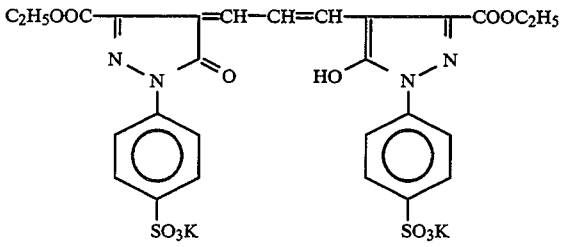

Dye [c] 50 mg/m²

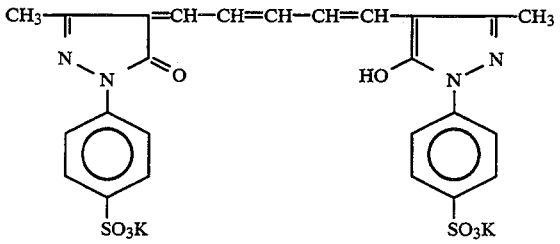

| Back protective layer | |
|---|---|
| Gelatin | 0.8 g/m² |
| Polymethyl methacrylate fine particles (grain size 4.5 μm) | 30 mg/m² |
| Sodium dihexyl-α-sulfosuccinate | 15 mg/m² |
| Sodium dodecylbenzenesulfonate | 15 mg/m² |
| Sodium acetate | 40 mg/m² |
| Fluorocarbon surfactant: $C_8H_{17}SO_2N(C_3H_7)CH_2COOK$ | 5 mg/m² |

Processing

There was prepared a developer of the following composition.

| Developer | |
|---|---|
| Hydroquinone | 50.0 g |
| N-methyl-p-aminophenol | 0.3 g |
| Sodium hydroxide | 18.0 g |
| 5-sulfosalicylic acid | 55.0 g |
| Potassium sulfite | 24.0 g |
| Disodium EDTA | 1.0 g |
| Potassium bromide | 10.0 g |
| 5-methylbenzotriazole | 0.4 g |
| Sodium 3-(5-mercaptotetrazole)benzenesulfonate | 0.2 g |
| N-n-butyldiethanolamine | 15.0 g |
| Sodium toluenesulfonate | 8.0 g |
| Water | totaling to 1 liter |
| Potassium hydroxide | pH adjusted to 10.7 |

Several test developers were prepared by adding anti-sludging agents to the developer as shown in Table 11.

TABLE 11

| Developer No. | Composition |
|---|---|
| D601 (comparison) | developer (free of the compound of the invention) |
| D602 (comparison) | developer + 0.13 g/l of comparative compound 1 (JP-A 204037/1984) |
| D603 (invention) | developer + 0.18 g/l of Compound (5) |
| D604 (invention) | developer + 0.17 g/l of Compound (6) |
| D605 (invention) | developer + 0.32 g/l of Compound (15) |
| D606 (invention) | developer + 0.31 g/l of Compound (18) |

The photosensitive material prepared above was exposed to 3200° K. tungsten light through an optical wedge for sensitometry. Using an automatic processor model FG-710F (manufactured by Fuji Photo-Film Co., Ltd.), the photosensitive material was subjected to a running test under the same conditions as in Example 5 except that development was done at 34° C. for 20 seconds and the developer was replenished in an amount of 60 ml per full-size sheet.

For fixation was used a fixer GR-F1 (manufactured by Fuji Photo-Film Co., Ltd.). It was replenished in an amount of 100 ml per full-size sheet.

The results of photographic properties in the running test are shown in Table 12 together with the silver sludging observations. Test Nos. 601 to 606 correspond to developer Nos. D601 to D606, respectively.

TABLE 12

| Run No. | Test | Fresh | 2400 sheets | Silver sludge in developer | Staining of photosensitive material |
|---|---|---|---|---|---|
| 601* | Fog | 0.04 | 0.04 | from 300th sheet | stained |
| | G | 18.1 | 16.1 | | |
| | S | 100 | 92 | | |
| | Dm | 5.11 | 4.91 | | |
| 602* | Fog | 0.04 | 0.04 | from 400th sheet | stained |
| | G | 17.4 | 16.6 | | |
| | S | 99 | 88 | | |
| | Dm | 5.03 | 4.90 | | |
| 603 | Fog | 0.03 | 0.03 | no sludge up to 2000 sheets | NO |
| | G | 17.9 | 17.2 | | |
| | S | 98 | 91 | | |
| | Dm | 5.05 | 4.95 | | |
| 604 | Fog | 0.03 | 0.03 | no sludge up to 2000 sheets | NO |
| | G | 17.1 | 16.7 | | |
| | S | 96 | 92 | | |
| | Dm | 5.01 | 4.96 | | |
| 605 | Fog | 0.03 | 0.03 | no sludge up to 2000 sheets | NO |
| | G | 17.3 | 16.7 | | |
| | S | 96 | 93 | | |
| | Dm | 5.02 | 4.95 | | |
| 606 | Fog | 0.03 | 0.03 | no sludge up to 2000 sheets | NO |
| | G | 17.7 | 16.9 | | |
| | S | 100 | 95 | | |
| | Dm | 5.08 | 5.02 | | |

It is seen from Table 12 that like Example 5, the running tests using developers containing the anti-sludging agents according to the present invention were successful in minimizing silver sludging with little influence on photographic properties.

Examples 7 to 12 demonstrate the effectiveness of compounds of formula (II) or (III).

Example 7

Example 1 was repeated except that the anti-sludging agent was replaced by compounds of formula (II) or (III).

A series of runs used different developers which were prepared by adding anti-sludging agents to the developer replenisher formulated in (6) of Example 1 as shown in Table 13.

TABLE 13

| Developer No. | Composition |
|---|---|
| D701 (comparison) | developer replenisher (free of the compound of the invention) |
| D702 (comparison) | developer replenisher + 0.16 g/l of compound of JP-A, 204,037/1984 |
| D703 (invention) | developer replenisher + 0.13 g/l of Compound (51) of the invention |
| D704 (invention) | developer replenisher + 0.14 g/l of Compound (52) of the invention |
| D705 (invention) | developer replenisher + 0.25 g/l of Compound (63) of the invention |
| D706 (invention) | developer replenisher + 0.22 g/l of Compound (77) of the invention |

It is to be noted that the comparative compound is a compound having the following formula in JP-A 204037/1984 and 53244/1991.

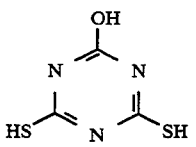

The results of the running test are shown in Table 14 together with the silver sludging observations. Test Nos. 701 to 706 correspond to developer Nos. D701 to D706, respectively.

TABLE 14

| Run No. | Test | Fresh | 600 sheets | 1200 sheets | Silver sludge in developer | Staining of photosensitive material |
|---|---|---|---|---|---|---|
| 701* | Fog | 0.04 | 0.04 | 0.04 | from 500th sheet | stained |
| | G | 2.75 | 2.72 | 2.74 | | |
| | S | 100 | 101 | 103 | | |
| | Dm | 3.51 | 3.53 | 3.48 | | |
| 702* | Fog | 0.04 | 0.04 | 0.04 | from 600th sheet | stained |
| | G | 2.76 | 2.73 | 2.76 | | |
| | S | 99 | 100 | 98 | | |
| | Dm | 3.48 | 3.49 | 3.51 | | |
| 703 | Fog | 0.04 | 0.04 | 0.04 | from 1100th sheet | NO |
| | G | 2.73 | 2.72 | 2.74 | | |
| | S | 101 | 99 | 100 | | |
| | Dm | 3.48 | 3.47 | 3.49 | | |
| 704 | Fog | 0.04 | 0.04 | 0.04 | from 1000th sheet | NO |
| | G | 2.73 | 2.76 | 2.74 | | |
| | S | 99 | 97 | 98 | | |
| | Dm | 3.48 | 3.51 | 3.52 | | |
| 705 | Fog | 0.04 | 0.05 | 0.04 | from 1100th sheet | NO |
| | G | 2.75 | 2.82 | 2.77 | | |
| | S | 101 | 102 | 99 | | |
| | Dm | 3.58 | 3.56 | 3.49 | | |
| 706 | Fog | 0.04 | 0.04 | 0.04 | from 1100th sheet | NO |
| | G | 2.74 | 2.77 | 2.71 | | |
| | S | 102 | 101 | 100 | | |
| | Dm | 3.48 | 3.50 | 3.52 | | |

As seen from Table 14, test Nos. 701 and 702 using developers D701 and D702 were satisfactory in photographic properties, but quite unsatisfactory in silver sludging. Silver sludging caused the processor to be contaminated internally, imposing a heavy burden on the maintenance of the processor. Silver sludging also caused staining of photosensitive material, leaving a serious problem with respect to the management of image quality. In contrast, test Nos. 703 to 706 using developers D703 to D706 containing the anti-sludging agents according to the present invention were successful in minimizing silver sludging with little influence on photographic properties.

Example 8

Example 2 was repeated except that the anti-sludging agent was replaced by compounds of formula (II) or (III).

Running tests were carried out in the 30-second processing sequence using developers containing Compounds (52), (53), (54), (59), (60), (61), (62), (63), (72), (76) and (77) of the invention. Outstanding improvements in silver sludging were achieved without substantial influence on photographic properties.

Example 9

Example 3 was repeated except that processing step (7) was changed as follows.

Using the photosensitive material prepared in (6) of Example 3, a running test was carried out as in Example 1. A roller conveyor type automatic processor model FPM-2000 (manufactured by Fuji Photo-Film Co., Ltd.) was modified so as to complete overall processing within 30 seconds on a dry-to-dry basis. Several developers were prepared from the developer (service solution) used in Example 2 by adding anti-sludging agents of formula (II) or (III) thereto as in Example 1. The fixer used was the same as in Example 2.

Both the developer and fixer were replenished in an amount of 20 ml per 10×12 inches.

In a photographic test, the photosensitive material was allowed to stand at 25° C. and RH 60% for 7 days and subjected to scanning exposure of $10^{-7}$ second at room temperature using semiconductor laser of 780 nm.

In the running tests on the 30 second process using developers having Compounds (52), (53), (58), (59), (62), (66) and (81) of the invention added thereto, silver sludging was markedly improved without substantial influence on photographic properties. Quite unexpectedly, when the photosensitive material was treated with developers having the compounds of the invention added thereto, the resulting image silver had an improved degree of blackness. With the developer free of the compound of the invention, the image silver was tinted yellow, presenting an unpleasant impression to an image viewer. This is probably due to a small grain size. The present invention is successful in overcoming the image tone problem.

Example 10

Example 4 was repeated except that the anti-sludging agent was replaced by compounds of formula (II) or (III).

The photosensitive material prepared in Example 3 was processed on a 30 second schedule by means of the same processor as used in Example 3 for examining photographic properties and the tone of developed silver images. Several developers were prepared from the developer (service solution) used in Example 2 by adding thereto anti-sludging agents, Compounds (51), (52), (62), (63) and (66) of the invention. The fixer used was the same as in Example 2. The results are shown in Table 15.

TABLE 15

| Run No. | Inventive compound in developer | Fog | G | S | DM | Developed silver image Tone | Evaluation |
|---|---|---|---|---|---|---|---|
| 1001* | none | 0.04 | 2.70 | 100 | 3.51 | yellowish black | NO |
| 1002 | 0.13 g/l compound (51) | 0.04 | 2.67 | 98 | 3.53 | somewhat yellowish black | NO |
| 1003 | 0.14 g/l compound (52) | 0.04 | 2.71 | 99 | 3.54 | neutral black | OK |
| 1004 | 0.21 g/l compound (62) | 0.04 | 2.73 | 101 | 3.50 | neutral black | OK |
| 1005 | 0.25 g/l compound (63) | 0.04 | 3.70 | 102 | 3.51 | neutral black | OK |
| 1006 | 0.21 g/l compound (66) | 0.04 | 2.75 | 100 | 3.49 | neutral black | OK |

As seen from Table 15, run No. 1002 with the developer containing Compound (51) of the invention achieved some improvement in silver image without any influence on photographic properties. In run Nos. 1003 to 1006 with the developers containing the anti-sludging agents of the invention, no substantial influence was exerted on photographic properties, and the tone of a silver image was favorably improved in that it was free of yellowness and had pure black tone finish.

Example 11

Example 5 was repeated except that processing step (3) was changed as follows.

Six test developers were prepared by adding anti-sludging agents to the developer of Example 5 as shown in Table 16. The comparative compound is as identified in Example 7.

TABLE 16

| Developer No. | Composition |
|---|---|
| D1101 (comparison) | developer replenisher (free of the compound of the invention) |
| D1102 (comparison) | developer replenisher + 0.16 g/l of compound of JP-A 204037/1984 |
| D1103 (invention) | developer replenisher + 0.13 g/l of Compound (51) of the invention |

TABLE 16-continued

| Developer No. | Composition |
|---|---|
| D1104 (invention) | developer replenisher + 0.16 g/l of Compound (53) of the invention |
| D1105 (invention) | developer replenisher + 0.17 g/l of Compound (60) of the invention |
| D1106 (invention) | developer replenisher + 0.30 g/l of Compound (78) of the invention |

The photosensitive material prepared in (2) of Example 5 was exposed to a xenon flash lamp for a flashing time of $10^{-6}$ sec. through an interference filter having a peak at 488 nm and a continuous wedge. Using an automatic processor model FG-710 NH (manufactured by Fuji Photo-Film Co., Ltd.), the photosensitive material was subjected to a running test under the following conditions.

| Step | Temp. | Time |
|---|---|---|
| Development | 38° C. | 14 sec. |
| Fixation | 37° C. | 9.7 sec. |
| Washing | 26° C. | 9 sec. |
| Squeezing | | 2.4 sec. |
| Drying | 55° C. | 8.3 sec. |
| Total | | 43.4 sec. |

The running test included the following conditions. On every operating day, 100 full-size (50.8 cm×61 cm) sheets of film were processed. This running process was continued over two weeks, with the accumulative number of processed sheets amounting to 1,200. The developer was replenished in an amount of 50 ml per full-size sheet.

For fixation was used a fixer LF-308 (manufactured by Fuji Photo-Film Co., Ltd.). It was replenished in an amount of 100 ml per full-size sheet.

The photosensitive material processed was examined for photographic properties by sensitometry in the same manner as in Example 5.

The results of the running test are shown in Table 17 together with the silver sludging observations. Test Nos. 1101 to 1106 correspond to developer Nos. D1101 to D1106, respectively.

TABLE 17

| Run No. | Test | Fresh | 600 sheets | 1200 sheets | Silver sludge in developer | Staining of photosensitive material |
|---|---|---|---|---|---|---|
| 1101* | Fog | 0.04 | 0.04 | 0.05 | from 200th sheet | stained |
| | G | 6.00 | 6.05 | 6.10 | | |
| | S | 100 | 99 | 102 | | |
| | Dm | 5.10 | 5.10 | 5.06 | | |
| 1102* | Fog | 0.04 | 0.05 | 0.04 | from 300th sheet | stained |
| | G | 5.77 | 5.73 | 5.69 | | |
| | S | 98 | 96 | 94 | | |
| | Dm | 5.03 | 5.01 | 5.01 | | |
| 1103 | Fog | 0.04 | 0.05 | 0.04 | from 1000th sheet | NO |
| | G | 5.83 | 5.81 | 5.88 | | |
| | S | 98 | 97 | 101 | | |
| | Dm | 5.10 | 5.08 | 5.13 | | |

TABLE 17-continued

| Run No. | Test | Fresh | 600 sheets | 1200 sheets | Silver sludge in developer | Staining of photosensitive material |
|---|---|---|---|---|---|---|
| 1104 | Fog | 0.04 | 0.04 | 0.04 | from 1100th sheet | NO |
| | G | 5.88 | 5.89 | 5.92 | | |
| | S | 101 | 100 | 99 | | |
| | Dm | 5.07 | 5.08 | 5.11 | | |
| 1105 | Fog | 0.05 | 0.04 | 0.04 | from 1100th sheet | NO |
| | G | 5.70 | 5.72 | 5.79 | | |
| | S | 99 | 100 | 102 | | |
| | Dm | 5.10 | 5.06 | 5.07 | | |
| 1106 | Fog | 0.04 | 0.04 | 0.04 | from 1000th sheet | NO |
| | G | 5.77 | 5.85 | 5.93 | | |
| | S | 99 | 97 | 97 | | |
| | Dm | 5.07 | 5.06 | 5.09 | | |

As seen from Table 17, run Nos. 11001 and 1102 using developers D1101 and D1102 were satisfactory in photographic properties, but quite unsatisfactory in silver sludging. Silver sludging caused the processor to be contaminated internally, imposing a heavy burden on the processor maintenance. Silver sludging also caused staining of photosensitive material, leaving a serious problem with respect to the management of image quality. In contrast, test Nos. 1103 to 1106 using developers D1103 to D1106 containing the anti-sludging agents according to the present invention were successful in minimizing silver sludging with little influence on photographic properties.

TABLE 18-continued

| Developer No. | Composition |
|---|---|
| D1202 (comparison) | developer + 0.16 g/l of comparative compound of JP-A 204037/1984 |
| D1203 (invention) | developer + 0.26 g/l of Compound (54) |
| D1205 (invention) | developer + 0.17 g/l of Compound (72) |
| D1206 (invention) | developer + 0.23 g/l of Compound (76) |

The results of photographic properties in the running test are shown in Table 19 together with the silver sludging observations. Test Nos. 1201 to 1206 correspond to developer Nos. D1201 to D1206, respectively.

TABLE 19

| Run No. | Test | Fresh | 600 sheets | 1200 sheets | Silver sludge in developer | Staining of photosensitive material |
|---|---|---|---|---|---|---|
| 1201* | Fog | 0.04 | 0.04 | 0.04 | from 300th sheet | stained |
| | G | 18.0 | 17.0 | 16.0 | | |
| | S | 100 | 95 | 90 | | |
| | Dm | 5.10 | 5.00 | 4.90 | | |
| 1202* | Fog | 0.04 | 0.04 | 0.04 | from 400th sheet | stained |
| | G | 17.3 | 16.8 | 16.2 | | |
| | S | 98 | 95 | 92 | | |
| | Dm | 5.04 | 5.01 | 4.97 | | |
| 1203 | Fog | 0.03 | 0.04 | 0.03 | from 1000th sheet | NO |
| | G | 18.2 | 17.8 | 17.3 | | |
| | S | 98 | 95 | 92 | | |
| | Dm | 5.04 | 5.01 | 4.97 | | |
| 1204 | Fog | 0.03 | 0.03 | 0.03 | from 1100th sheet | NO |
| | G | 18.1 | 17.5 | 17.1 | | |
| | S | 98 | 94 | 90 | | |
| | Dm | 5.02 | 4.97 | 4.90 | | |
| 1205 | Fog | 0.03 | 0.04 | 0.03 | from 1100th sheet | NO |
| | G | 17.7 | 17.2 | 16.8 | | |
| | S | 98 | 93 | 91 | | |
| | Dm | 5.00 | 4.97 | 4.90 | | |
| 1206 | Fog | 0.03 | 0.03 | 0.03 | from 1100th sheet | NO |
| | G | 17.9 | 17.4 | 17.3 | | |
| | S | 102 | 98 | 95 | | |
| | Dm | 5.10 | 5.07 | 5.00 | | |

Example 12

Example 6 was repeated except that the anti-sludging agent was replaced by compounds of formula (II) or (III).

Several test developers were prepared by adding anti-sludging agents to the developer of Example 6 as shown in Table 18. The comparative compound is as identified in Example 7.

TABLE 18

| Developer No. | Composition |
|---|---|
| D1201 (comparison) | developer (free of the compound of the invention) |

It is seen from Table 19 that the running tests using developers containing the anti-sludging agents according to the present invention were successful in minimizing silver sludging with little influence on photographic properties.

For the development of silver halide photosensitive material with a developer, silver sludging or staining can be significantly suppressed by adding a six-membered heterocyclic compound of formula (I), (II) or (III) to the developer. Reduced silver sludging leads to easier maintenance of the processor and eliminates staining of photosensitive material being processed with the developer, assisting in consistently forming images of quality even in the case of a rapid process.

We claim:

1. A method for developing a silver halide photosensitive material after exposure comprising the step of treating the material with a developer containing a six-membered heterocyclic compound of the general formula (I) in an amount of from 0.01 to 5 grams per liter:

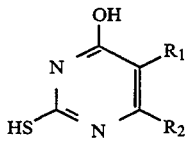

(I)

wherein $R_1$ and $R_2$ are independently selected from the group consisting of a hydrogen atom, halogen atom, alkyl, aryl, aralkyl, hydroxyl, mercapto, carboxyl, sulfo, phosphono, nitro, cyano, alkoxycarbonyl, aryloxycarbonyl, carbamoyl, sulfamoyl, and alkoxy group, the sum of carbon atoms in both $R_1$ and $R_2$ ranges from 2 to 20, and $R_1$ and $R_2$, taken together, may form a saturated ring structure, wherein a replenisher containing a compound of formula (I) is added to the developer to maintain a concentration of compound (I) in the developer of from 0.01 to 5 grams per liter.

2. A method for processing a silver halide photosensitive material after exposure comprising the steps of developing and fixing the material for forming an image therein, in the developing step, the material is treated with a developer containing at least (a) a compound of the general formula (I) in an amount of from 0.01 to 5 grams per liter:

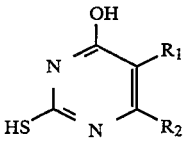

(I)

wherein $R_1$ and $R_2$ are independently selected from the group consisting of a hydrogen atom, halogen atom, alkyl, aryl, aralkyl, hydroxyl, mercapto, carboxyl, sulfo, phosphono, nitro, cyano, alkoxycarbonyl, aryloxycarbonyl, carbamoyl, sulfamoyl, and alkoxy group, the sum of carbon atoms in both $R_1$ and $R_2$ ranges from 2 to 20, and $R_1$ and $R_2$, taken together, may form a saturated ring structure, (b) a dihydroxybenzene developing agent, (c) at least 0.3 mol/liter of a free sulfite, and (d) at least one of 1-phenyl-3-pyrazolidone and aminophenol developing agents, wherein a replenisher containing a compound of formula (I) is added to the developer to maintain a concentration of compound (I) in the developer of from 0.01 to 5 grams per liter.

3. The method of claim 1 or 2 wherein in formula (I), either one of $R_1$ and $R_2$ is a substituted or unsubstituted alkyl group having 1 to 10 carbon atoms, a substituted or unsubstituted aryl group having 6 to 12 carbon atoms, a substituted or unsubstituted aralkyl group having 7 to 12 carbon atoms, or a halogen atom, or $R_1$ and $R_2$, taken together, form a saturated 5 or 6-membered ring.

4. The method of claim 1 or 2 wherein in formula (I), $R_1$ is a hydrogen atom or an alkyl group having an amino group or heterocyclic ring as a substituent and $R_2$ is a substituted or unsubstituted alkyl group having 1 to 10 carbon atoms or a substituted or unsubstituted aryl group having 6 to 12 carbon atoms, or $R_1$ and $R_2$, taken together, form a saturated 5 or 6-membered ring.

5. The method of claim 1 or 2 wherein the compound of formula (I) is Compound (5) or (6):

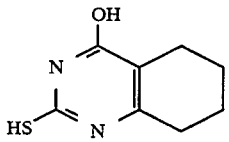

(5)

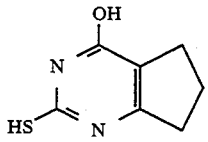

(6)

* * * * *